United States Patent [19]

Aoki

[11] Patent Number: 4,638,135

[45] Date of Patent: Jan. 20, 1987

[54] INDUCTION HEAT COOKING APPARATUS

[75] Inventor: Masayuki Aoki, Nagoya, Japan

[73] Assignee: Kabushiki Kaisha Toshiba, Kawasaki, Japan

[21] Appl. No.: 689,338

[22] Filed: Jan. 7, 1985

[30] Foreign Application Priority Data

Jan. 20, 1984 [JP] Japan ..... 59-7961
Feb. 10, 1984 [JP] Japan ..... 59-23087

[51] Int. Cl.[4] ..... H05B 6/06

[52] U.S. Cl. ..... 219/10.49 R; 219/10.77; 219/497

[58] Field of Search ..... 219/10.77, 10.49 R, 219/10.55 B, 497, 499, 494, 506

[56] References Cited

U.S. PATENT DOCUMENTS

| | | | |
|---|---|---|---|
| 3,553,429 | 1/1971 | Nelson | 219/497 |
| 3,876,924 | 4/1975 | Peters, Jr. | 219/10.77 |
| 3,903,395 | 9/1975 | Hamstra | 219/497 |
| 4,110,588 | 8/1978 | Holz | 219/10.49 R |
| 4,308,443 | 12/1981 | Tucker et al. | 219/10.77 |
| 4,314,143 | 2/1982 | Bilstad et al. | 219/497 |
| 4,355,222 | 10/1982 | Geithman et al. | 219/10.77 X |
| 4,370,535 | 1/1983 | Noda | 219/10.55 B |
| 4,453,068 | 6/1984 | Tucker et al. | 219/10.77 |
| 4,506,127 | 3/1985 | Satoh | 219/10.55 B |

FOREIGN PATENT DOCUMENTS

| | | |
|---|---|---|
| 2901556 | 7/1980 | Fed. Rep. of Germany . |
| 3102668 | 12/1981 | Fed. Rep. of Germany . |
| 59-91690 | 5/1984 | Japan . |
| 1019901 | 2/1966 | United Kingdom . |
| 2041583 | 9/1980 | United Kingdom . |

*Primary Examiner*—Philip H. Leung
*Attorney, Agent, or Firm*—Cushman, Darby and Cushman

[57] ABSTRACT

In an induction heat cooking apparatus of the invention, an electromagnetic field is generated by a heating coil, and the generated electromagnetic field is supplied to a load so that the load is inductively heated. The cooking apparatus includes an exciter circuit for exciting the heating coil to generate the electromagnetic field; a temperature set circuit for providing a temperature set signal which designates a given target temperature of the load; and a temperature measure circuit for measuring the temperature of the load to generate a temperature measure signal which represents the measured temperature of the load. The cooking apparatus further includes a difference detector circuit for detecting a difference between the temperature set signal and the temperature measure signal and generating a difference signal. The exciter circuit receives the difference signal so as to control heat power for the heating coil.

19 Claims, 39 Drawing Figures

E16X (Tm)
E17X
(Ts)
TIME

"1"
E24X
"0"
TIME

E25X
TIME

E36X
TIME

AVERAGE
HEAT POWER
TIME t10
t12
t14
t16
t18

INDUCTION HEAT COOKING APPARATUS

BACKGROUND OF THE INVENTION

The present invention relates to an induction heat cooking apparatus in which a high frequency electromagnetic field is generated by a heating coil, and the generated electromagnetic field is supplied to a load so that the load is inductively heated.

In a conventional induction heat cooking apparatus, a temperature sensor is mounted at the rear surface (heating coil side) of a top plate on which a load or vessel is placed. The vessel temperature measured by the temperature sensor is compared with a set temperature. The set temperature is preset by a temperature set portion located at a manipulation part of the cooking apparatus. When the vessel temperature comes close to the set temperature, the heating power is decreased. Further, if the vessel temperature exceeds the set temperature, heating is stopped or any other proper process is performed so that the vessel is kept at a suitable temperature around the set temperature.

According to the above conventional cooking apparatus, however, the cooking apparatus operator cannot determine whether or not the vessel is really kept at a desired or optimum temperature. Because of this, regardless of the above vessel temperature control function, the resultant cooked food could be untasty. For instance, when fried food is cooked, even if the oil temperature in a vessel is optimum, putting in the frying material renders the oil temperature lower, thereby impairing the quality of the resultant fried food.

Further, in a conventional induction heat cooking apparatus, if heating is carried out without use of a standard vessel or if heating is carried out by using a strange vessel whose material and/or size are not standard the heating coil is subjected to excessive overcurrent, resulting in damage to the heating coil as well as other associated materials. To prevent such damage, in a conventional induction heat cooking apparatus, whether or not a standard vessel is properly used is detected, and the detected result is indicated. If a standard vessel is not properly set, the excitation of the heating coil is inhibited.

One method for judging whether or not a standard vessel is properly set utilizes magnetism. According to this method, however, even though a vessel with a magnetic substance can be detected, a nonmagnetic heatable vessel such as an 18-8 stainless steel vessel cannot be detected.

Another method for judging whether or not a standard vessel is properly set detects a voltage and current of a temporarily excited heating coil at the time when the heating starts, or it detects a voltage and current of an excited heating coil during the heating. According to this method, it is possible to detect not only a magnetic vessel but also a nonmagnetic 18-8 stainless steel vessel.

In recent years, an induction heat cooking apparatus having a temperature adjusting function has been developed for the purpose of convenience. Such a cooking apparatus is provided with a temperature sensor portion for measuring the temperature of a vessel and a temperature set portion for presetting the vessel temperature. In such a cooking apparatus, heating is effected when the vessel temperature is lower than the set temperature, and heating is interrupted when the vessel temperature exceeds the set temperature. Then, the vessel temperature is roughly maintained around the set temperature. However, when a load detecting function based on the detection of a voltage and current is adapted to the above induction heat cooking apparatus, a disadvantage could develop. That is, since the load detecting function is disenabled under the interruption of heating, if a standard vessel is replaced with a nonstandard vessel at the time of the interruption, no indication for such an improper replacement is indicated. Such a situation discredits the cooking apparatus in the eyes of the operator.

SUMMARY OF THE INVENTION

It is accordingly an object of the present invention to provide an improved induction heat cooking apparatus which generates prescribed heating power corresponding to the change in load temperature, so that the load temperature is kept near a given set temperature, thereby ensuring good cooking.

Another object of the invention is to provide a reliable induction heat cooking apparatus which can infallibly inform a cooking apparatus operator whether or not a prescribed load is properly set.

To achieve the former object, an induction heat cooking apparatus of the invention is provided with a means for detecting a difference between a set temperature being preset by a temperature set portion and a load temperature measured by a temperature sensor portion, and a means for exciting a heating coil in accordance with the result of the detection of said detecting means.

To achieve the latter object, an inverter circuit of the cooking apparatus is continuously actuated when the load temperature is lower than the set temperature, while the inverter circuit is intermittently actuated for the time required to detect the load when the load temperature exceeds the set temperature.

According to an induction heat cooking apparatus of the invention, it is possible to provide an improved induction heat cooking apparatus which can infallibly maintain the temperature of a load to an optimum value.

According to another induction heat cooking apparatus of the invention, it is possible to obtain a reliable induction heat cooking apparatus which can always execute a correct load detection independently of the function of temperature adjusting and can infallibly inform a cooking apparatus operator whether or not a proper load is set.

BRIEF DESCRIPTION OF THE DRAWINGS

FIGS. 13A-1 to 13C-2 jointly show a detailed circuit diagram of another embodiment of the invention;

DETAILED DESCRIPTION OF THE PREFERRED EMBODIMENTS

Hereinafter, preferred embodiments of the invention will be described in detail with reference to the accompanying drawings.

Figure 1A:
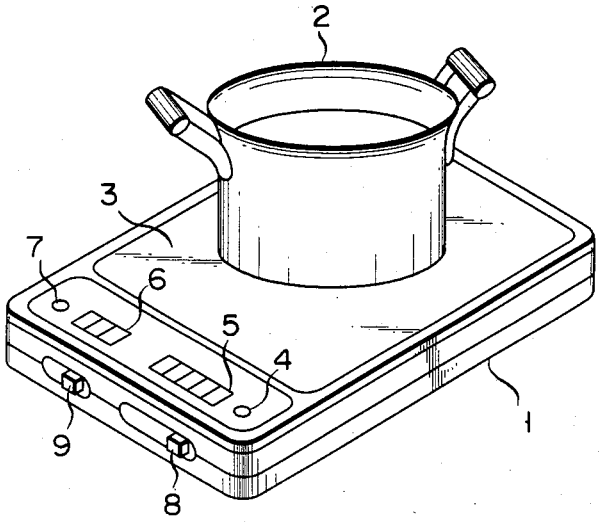
FIG. 1A illustrates a perspective view of the cooking apparatus.
Figure 1B:
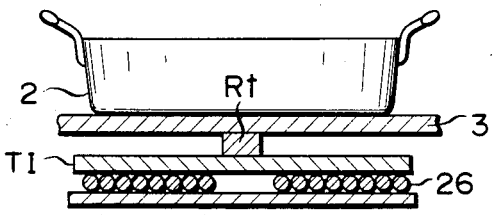
FIG. 1B illustrates a partial sectional view of the cooking apparatus in FIG. 1A.

Referring to FIG. 1A, reference numeral 1 denotes a main body of the induction heat cooking apparatus. A vessel (or load) 2 is placed on a top plate 3 mounted on the upper surface of a main body 1. A part of the upper surface of main body 1 is provided with a cooking lamp 4, an output and set temperature indicator 5, a heat mode indicator 6 and an optimum temperature indicator lamp 7. One side of main body 1 is provided with an output and temperature set controller 8 and a heat mode change switch 9. As shown in FIG. 1B, a thermistor Rt is mounted on the rear surface of top plate 3 and is placed close to a heating coil 26 via a thermal insulation material TI.

Figure 2:
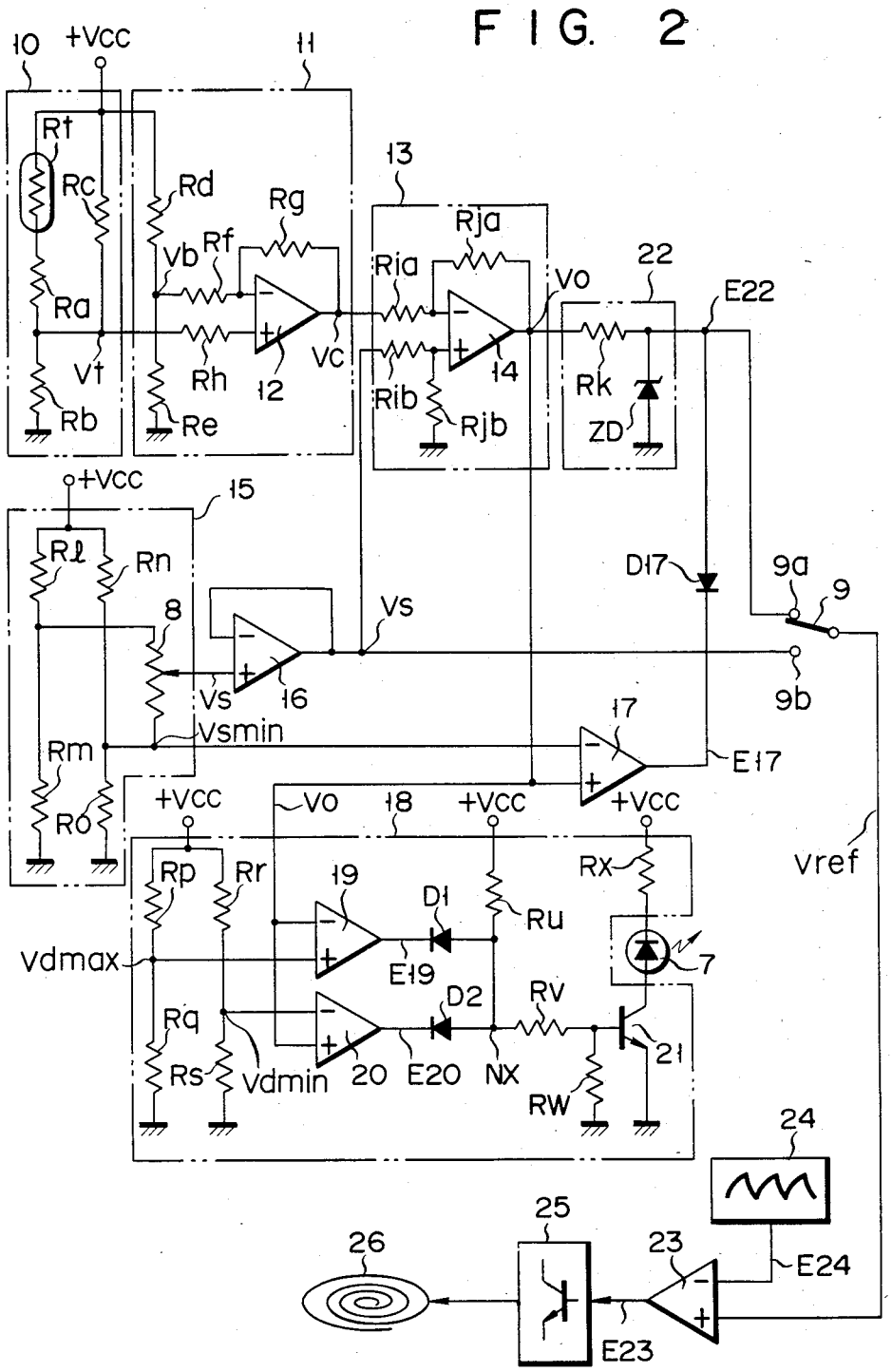
FIG. 2 shows the configuration of a control circuit of an embodiment according to the present invention.

FIG. 2 shows a configuration of a control circuit. Reference numeral 10 denotes a thermistor circuit or a temperature/voltage converter which serves as a temperature sensor for measuring the temperature of vessel 2. Thermistor circuit 10 is formed of a thermistor Rt and resistors Ra, Rb and Rc. Thermistor Rt is connected in series to Ra and Rb, and resistor Rc is connected in parallel to the series circuit of Rt and Ra. The node between Rt and Rc receives a power supply potential +Vcc, and Rb is circuit-grounded. Thermistor circuit 10 generates a temperature voltage Vt at the node between Ra and Rb. The potential of voltage Vt corresponds to the temperature of vessel 2 placed on top plate 3 (FIG. 1B).

Reference numeral 11 denotes a compensation circuit. Circuit 11 is formed of resistors Rd, Re, Rf, Rg and Rh and an operational amplifier 12. The series circuit of Rd and Re is connected between the +Vcc circuit and the circuit ground. The node between Rd and Re provides a reference voltage Vb. Voltage Vb is supplied via Rf to the inverted input of amplifier 12, and voltage Vt from circuit 10 is supplied via Rh to the noninverted input of amplifier 12. The output of amplifier 12 is fed via Rg back to the inverted input thereof. Circuit 11 is responsive to Vt and Vb and provides a temperature measured signal Vc having a potential corresponding to the potential difference between Vt and Vb. Signal Vc represents a measured temperature Tm of vessel 2.

Reference numeral 13 denotes a subtraction circuit. Circuit 13 is formed of resistors Ria, Rib, Rja and Rjb and an operational amplifier 14. The inverted input of amplifier 14 receives via Ria the signal Vc from circuit 11. The output of amplifier 14 is fed via Rja back to the inverted input thereof. The noninverted input of amplifier 14 is circuit-grounded via Rjb and receives via Rib a temperature set signal Vs which will be mentioned later. Circuit 13 outputs a difference signal Vo. Signal Vo corresponds to the difference between signal Vc and signal Vs.

Temperature set signal Vs is obtained from a temperature set portion 15. Portion 15 is formed of resistors Rl, Rm, Rn and Ro and the output and temperature set controller 8 (FIG. 1A). The series circuit of Rl and Rm is connected between the +Vcc circuit and the circuit ground, and the series circuit of Rn and Ro is connected between the +Vcc circuit and the circuit ground. Controller 8 is connected between the node of R1 and Rm and the node of Rn and Ro. The slider contact of controller 8 provides signal Vs. The node between Rn and Ro provides a comparison signal Vsmin which defines the minimum value of Vs. Signal Vs can be optionally changed by the manipulation of controller 8. The value of signal Vs represents a target temperature or a set temperature Ts. Signal Vs from portion 15 is supplied to subtraction circuit 13 via a voltage follower 16 having a unit gain (0dB). Voltage follower 16 serves to eliminate influence of an input impedance of the following stage to the value of Vs.

The upper limit of the potential of difference signal Vo is defined by a limiter 22. Limiter 22 is formed of a voltage dividing circuit of a resistor Rk and Zener diode ZD. When the potential of Vo falls below the Zener voltage ZD, limiter 22 outputs a difference signal E22 having a potential being equal to the potential of Vo. If the potential of Vo exceeds the Zener voltage, the potential of E22 is restricted to the Zener voltage ZD.

Comparison signal Vsmin from portion 15 is applied to the inverted input of a comparator 17. The noninverted input of comparator 17 receives signal Vo from subtraction circuit 13. The output of comparator 17 is coupled via a diode D17 to the output circuit of limiter 22. Comparator 17 may be a conventional hysteresis comparator whose input thershold level has a given hysteresis characteristic. When the potential of Vo falls below the potential of Vsmin defining the minimum value of Vs, comparator 17 renders the potential of E22 to be substantially zero.

Reference numeral 18 denotes an optimum temperature indication circuit which contains a comparator circuit. Circuit 18 is formed of resistors Rp, Rq, Rr, Rs, Ru, Rv, Rw and Rx, comparators 19 and 20, diodes D1 and D2 and an NPN transistor 21. The series circuit of Ru, Rv and Rw is connected between the +Vcc circuit and the circuit ground. The node NX between Ru and Rv is coupled via D1 to the output of comparator 19 and also coupled via D2 to the output of comparator 20. The node between Rv and Rw is connected to the base of transistor 21. The emitter of transistor 21 is circuit-grounded, and the collector thereof is coupled via an LED 7 and resistor Rx to the +Vcc circuit. LED 7 corresponds to indicator lamp 7 in FIG. 1A. The series circuit of Rp and Rq is connected between the +Vcc circuit and the circuit ground. The series circuit of Rr and Rs is connected between the +Vcc circuit and the circuit ground. The node between Rp and Rq provides an upper limit level Vdmax. The node between Rr and Rs provides a lower limit level Vdmin. Level Vdmax is applied to the noninverted input of comparator 19. Level Vdmin is applied to the inverted input of comparator 20. The inverted input of comparator 19 and the noninverted input of comparator 20 receive the difference signal Vo from subtraction circuit 13.

Comparator 19 compares Vdmax with Vo and provides a first comparison output E19 having logic "1" level if Vo<Vdmax. Comparator 20 compares Vdmin with Vo and provides a second comparison output E20 having a logic "1" level if Vo>Vdmin. If Vo>Vdmax, E19 becomes logic "0." If Vo<Vdmin, E20 becomes logic "0." When E19 and E20 become logic "1," the potential at node NX is high, and transistor 21 is turned on so that LED 7 is lit. When E19 or E20 becomes logic "0," the potential at node NX becomes substantially zero so that transistor 21 is turned off. In this case, LED 7 is not lit.

Optimum temperature indication circuit 18 judges whether or not the difference between the set temperature Ts and the measured temperature Tm of vessel 2 falls within a predetermined range. The upper limit of the predetermined range is defined by level Vdmax, and the lower limit thereof is defined by level Vdmin. Circuit 18 controls the on/off of LED 7 according to the results of the judgment.

Difference signal E22 from limiter 22 is supplied to a contact 9*a* of heat mode change switch 9. Contact 9*a* is provided for a temperature control of the cooking apparatus. An output Vs from voltage follower 16 is supplied to a contact 9*b* of switch 9. Contact 9*b* is provided for an output adjustment of the cooking apparatus. Switch 9 selects either one of E22 and Vs. The selected one (E22 or Vs) is used as an exciter control signal Vref. Signal Vref from switch 9 is supplied to the noninverted input of a comparator 23. The inverted input of comparator 23 receives a sawtooth-wave signal E24 from a sawtooth-wave generator 24. In this circuit connection, signal E24 is pulse-width-modulated (PWM) by signal Vref. A pulse signal E23 outputted from comparator 23 is supplied to an inverter circuit 25. Circuit 25 contains a switching element which is on/off controlled by signal E23. A resonance circuit being formed of heating coil 26 (cf. FIG. 1B) and a capacitor (not shown) is oscillatingly excited by circuit 25, so that a high frequency current flows into heating coil 26.

The circuit operation of the above configuration will be as follows.

First, an explanation will be given with reference to FIGS. 3A to 3E.

Under proper selection of the respective values of resistors Ra, Rb and Rc, temperature voltage Vt from thermistor circuit 10 may have an approximate linear function of (FIG. 3A):

$$Vt=A.Tm+B \tag{1}$$

Here, each of the symbols A and B is a constant, and Tm denotes the measured temperature or the vessel temperature. Compensation circuit 11 receives voltage Vt and outputs a temperature measuring signal Vc which may be represented by (FIG. 3B):

$$Vc=(1+Rg/rf)Vt-Rg/Rf\cdot Vb \tag{2}$$

Here, Vb is a voltage obtained from the voltage divider of resistors Rd and Re. When the value of Vb is changed, the functional line of Vc is shifted parallel along the arrow in FIG. 3B, as shown by the two-dot dash line. On the other hand, for the purpose of easy manipulation, temperature set signal Vs from temperature set portion 15 is selected to have a linear function of (FIG. 3C):

$$Vs=C\cdot Ts+D \tag{3}$$

Figure 3A:
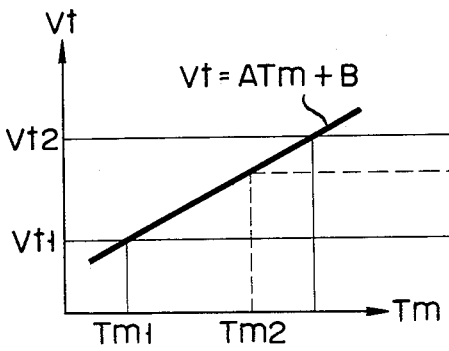
FIGS. 3A. to 3E show graphs respectively used for explaining the operation of the apparatus in FIG. 2.
Figure 3B:
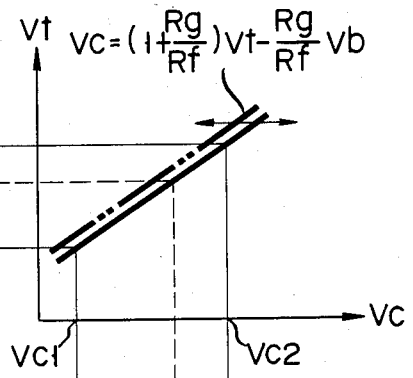
Figure 3C:
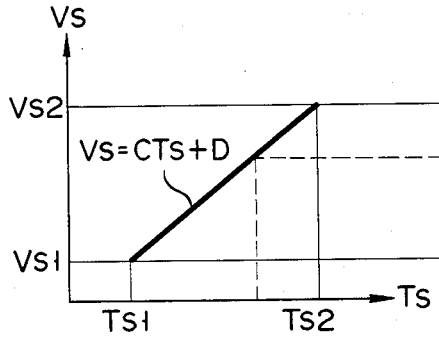
Figure 3D:
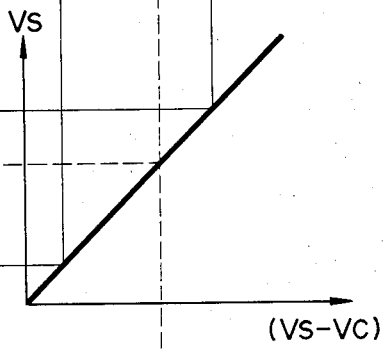

Here, each of symbols C and D is a constant, and Ts denotes the set temperature. The relation between Vs and (Vs−Vc) is as shown in FIG. 3D.

Subtraction circuit 13 provides signal Vo corresponding to the difference between Vc and Vs. Signal Vo may be represented as:

$$\begin{aligned} Vo &= Rj/Ri.(Vs - Vc) \\ &= Rj/Ri.\{C.Ts + D - (1 + Rg/Rf)Vt + Rg/Rf.Vb\} \\ &= Rj/Ri.\{C.Ts + D - (1 + Rg/Rf)(A.Tm + B) + Rg/Rf.Vb\} \\ &= Rj/Ri.\{C.Ts - (1 + Rg/Rf)A.Tm + D + Rg/Rf.Vb - (1 + Rg/Rf)B\} \end{aligned} \tag{4}$$

provided that Rj=Rja=Rjb and Ri =Ria=Rib. When the value of Rg/Rf is selected to be:

$$C=(1+Rg/Rf)A \tag{5}$$

the function of Vo is simplified as:

$$Vo=Rj/Ri\cdot\{C(Ts-Tm)+D+Rg/Rf\cdot Vb-(1+Rg/Rf)B\} \tag{6}$$

Above equation (6) teaches that Vo has a linear functional relation with the difference (Ts−Tm) between set temperature Ts and measured temperature Tm. Thus, the following equation is obtained (FIG. 3E):

$$Vo=E(Ts-Tm)+F \tag{7}$$

wherein each of symbols E and F is a constant, i.e., $$E=Rj/Ri\cdot C \tag{8}$$ and $$F=Rj/Ri\cdot\{(D+Rg/Rf\cdot Vb-(1+Rg/Rf)B\} \tag{9}$$

Under proper selection of the value of F, the value of Vo becomes equal to F when the measured temperature Tm reaches the set temperature Ts, or when the relation $$(Ts-Tm)=0 \tag{10}$$

is established.

Now, assume that certain over and under deviations from the value of F are prefixed. Then, if the value of Vo falls within the prefixed range of the above deviations, the parameter (Ts−Tm) also falls within a corresponding predetermined range. This predetermined range defines the optimum temperature. When the value of Vo falls within the above prefixed range, optimum temperature indication circuit 18 excites LED 7 to indicate that the optimum temperature has been obtained.

Figure 4:
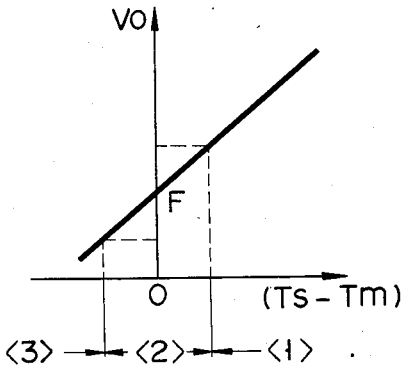
FIG. 4 shows another graph used for explaining the operation of the apparatus in FIG. 2.
Figure 3E:
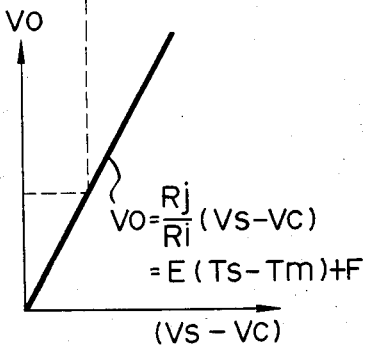

Now, descriptions will be given of the operation of optimum temperature indication circuit 18 with reference to FIG. 4. First, a non-optimum temperature region <1> in FIG. 4 is considered, wherein measured temperature Tm is lower than set temperature Ts. In this case, the potential of signal Vo from subtraction circuit 13 exceeds the potential of Vdmax at the noninverted input of comparator 19, so that the logic level of output E19 from comparator 19 becomes "0." Then, transistor 21 is turned-off and LED 7 for the optimum temperature indication is not lit.

When the value of the difference between Tm and Ts belongs to an optimum temperature region <2> in FIG. 4, the potential of Vo is lower than the potential of Vdmax, but the potential of Vo is higher than the potential of Vdmin at the inverted input of comparator 20. In this case, respective outputs E19 and E20 from comparators 19 and 20 becomes logic "1". Then, transistor 21 is turned-on and LED 7 for the optimum temperature indication is lit.

When measured temperature Tm exceeds set temperature Ts and the value of the difference between Tm and Ts belongs to a non-optimum temperature region <3> in FIG. 4, the potential of Vo falls below the potential of Vdmin at the inverted input of comparator 20. Then, the logic level of output E20 from comparator 20 becomes "0," so that transistor 21 is turned-off and LED 7 for the optimum temperature indication is not lit.

When the cooking is started under the selection of contact 9*a* of switch 9, exciter control signal Vref obtained from switch 9 corresponds to the difference signal Vo. The selected signal Vref (=E22 or Vo) is supplied to comparator 23. Comparator 23 performs a pulse-width-modulation in accordance with the potential of Vref, and heating coil 26 is excited or energized with an electrical output power corresponding to the temperature difference between Ts and Tm. Under the control of limiter 22 and comparator 17, the value of Vref falls within its maximum (ZD) and minimum (nearly zero) values, and heating coil 26 is excited so that vessel 2 is kept at the set or optimum temperature. (This will be described later with reference to FIGS. 6A to 6D.)

Now, an explanation will be given, with reference to FIGS. 5A to 5D, of a case wherein fried food (Japanese fry) is cooked.

Figures 5A, 5B, 5C, 5D:
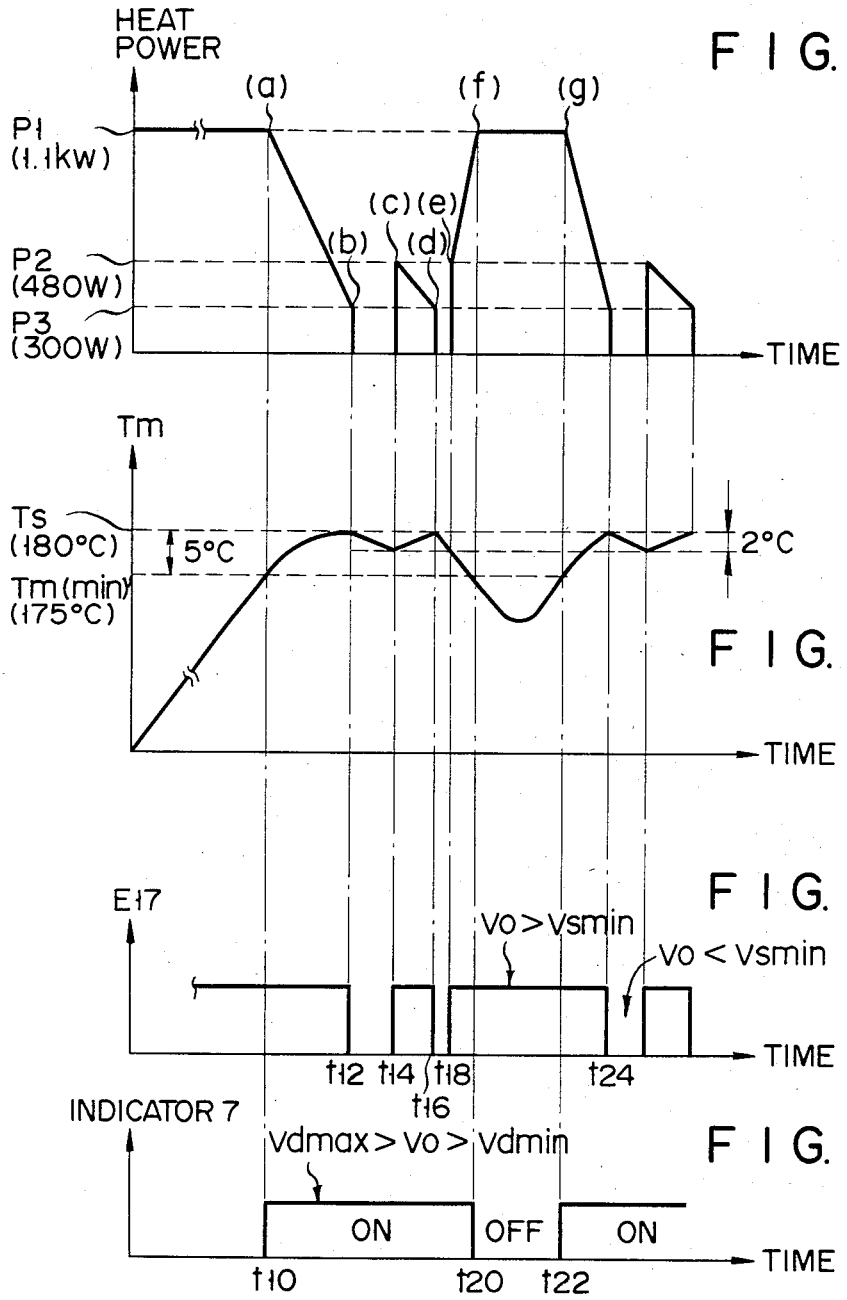
FIGS. 5A to 5D show graphs explaining a temperature control operation of the apparatus for frying.

After heating has started, heating coil 26 is excited with a high power Pl (e.g., 1.1 kW) which is defined by the Zener voltage ZD of limiter 22 (FIG. 5A, before t10). By inductive heating with power Pl, measured temperature Tm of vessel 2 rises rapidly (FIG. 5B, before t10). As the temperature of vessel 2 rises, the potential of Vc comes close to Vs so that the potential of Vo (=Vs−Vc) reduces (cf. FIG. 3E). When Vo falls below ZD (point (a) in FIG. 5A), the limiting function of limiter 22 is released and signal E22 becomes equal to Vo. At this moment, if Vo falls within the range between Vdmax and Vdmin, LED 7 is lit (t10 in FIG. 5D). Thus, the fact that the optimum temperature for frying food (e.g., 175° to 180° C.) has been obtained is indicated by LED 7. From this, the cooking apparatus operator can readily know a suitable time for putting in the frying material.

After the turn-on of LED 7, the heat power for vessel 2 is decreased with the potential down of E22 or Vo (points (a) to (b) in FIG. 5A). When Vo reaches Vsmin, comparator 17 generates logic "0" output E17 so that the potential of E22 becomes substantially zero (t12 in FIG. 5C). Then, the heat power for vessel 2 becomes zero (t12 in FIG. 5A). At this time, vessel 2 becomes the target or optimum temperature Ts (180° C., t12 in FIG. 5B). The heat power obtained at the time of Vo=Vsmin or Tm=Ts is P3 (e.g., 300 W at point (b) in FIG. 5A).

After the heat power is rendered zero, measured temperature Tm gradually reduces due to natural cooling (after t12 in FIG. 5B). When Tm is decreased to slightly below Ts (e.g., 178° C.), the logic level of E17 from comparator 17 is changed from "0" to "1" (t14 in FIGS. 5B and 5C). The value of the slight temperature down from Ts (from 180° C. to 178° C. in FIG. 5B) may be determined by a hysteresis characteristic of the input threshold of comparator 17. When Tm reaches the said temperature (178° C.) slightly below Ts (t14 in FIG. 5B), the logic level of E17 becomes "1" (t14 in FIG. 5C), and the heat power becomes P2 (e.g., 480 W, point (c) in FIG. 5A). Then, vessel 2 is softly heated with low power (points (c) to (d) in FIG. 5A) and Tm gradually rises from 178° C. to 180° C. (t14 to t16 in FIG. 5B). When Tm reaches Ts, the logic level of E17 again becomes "0" (t16 in FIG. 5C) and the heat power for vessel 2 becomes zero (t16 in FIG. 5A).

When putting in the frying material causes the temperature of the oil in vessel 2 to decrease so that measured temperature Tm deviates from the optimum temperature or Tm falls below Tm(min)=175° C. (after t20 in FIG. 5B), LED 7 is turned-off (t20 in FIG. 5D). From this, the cooking apparatus operator is informed that any further addition of the frying material will render the resultant fried material untasty.

When Tm falls below 178° C. (t18 in FIG. 5B), the logic level of E17 becomes "1" (t18 in FIG. 5C). If Tm further reduces (after t18 in FIG. 5B), the heat power is increased from P2 to Pl (points (e) to (f) in FIG. 5A). Then, the excessive temperature reduction of the oil in vessel 2 (after t20 in FIG. 5B) is rapidly cancelled by large heat power Pl. The heating with high power Pl renders Tm quickly increased (t20 to t22 in FIG. 5B). As Tm rises, the potential of Vo (=Vs−Vc) reduces. When Vo falls below ZD (point (g) in FIG. 5A), the limiting function of limiter 22 is released, and E22 becomes equal to Vo. At this moment, Vo falls within the range between Vdmax and Vdmin, and LED 7 is lit (t22 in FIG. 5D). Thus, the cooking apparatus operator can readily know a suitable time for further adding the frying material. Following this, when Tm reaches Ts (t24 in FIG. 5B), E17 from comparator 17 becomes logic "0" (t24 in FIG. 5C), and the heat power is reduced to zero (t24 in FIG. 5A).

From the indication of LED 7 as mentioned above, poor cooking can be avoided.

When an excessive temperature reduction as shown at time t20 to t22 in FIG. 5B does not occur, the temperature control operation of the FIG. 2 apparatus will be as shown in FIGS. 6A to 6D. Points (A), (B), (C) and (D) in FIG. 6A correspond to points (a), (b), (c) and (d) in FIG. 5A, respectively. Generally, the temperature control as shown in FIGS. 6A to 6D will be performed in the temperature maintaining operation.

Figure 6A:
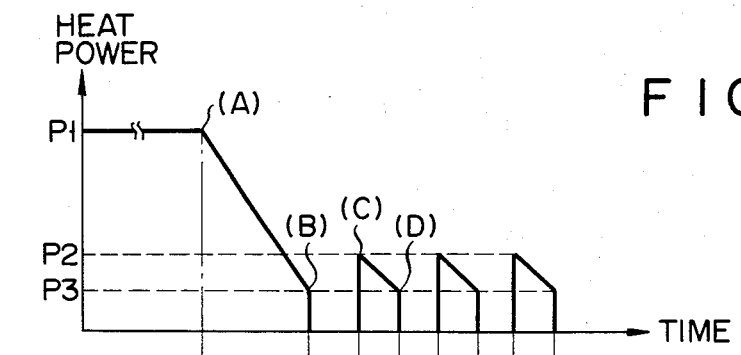
FIGS. 6A to 6D show graphs explaining a temperature maintaining operation of the apparatus.
Figure 6B:
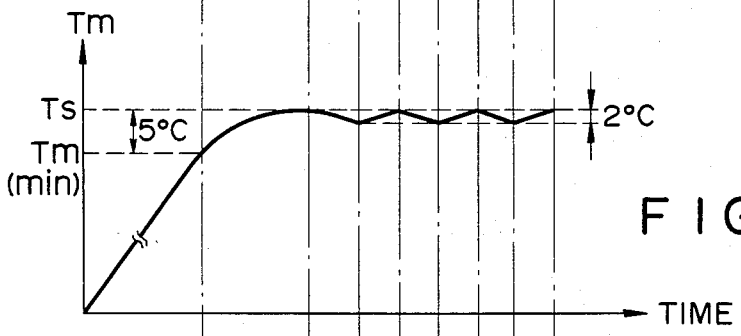
Figure 6C:
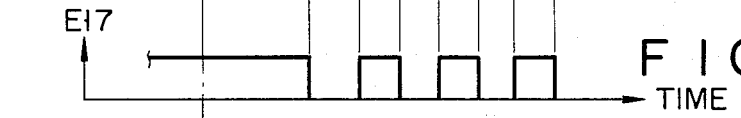
Figure 6D:
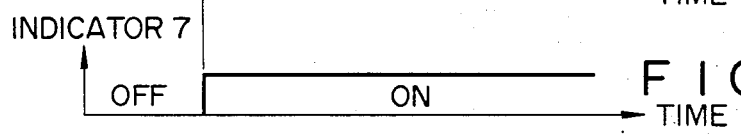

From the indication of LED 7 as shown in FIG. 6D, where a desired temperature (Ts) should be maintained during cooking, the cooking apparatus operator can clearly know whether or not the desired temperature is being maintained, thereby achieving good cooking.

Figure 7:
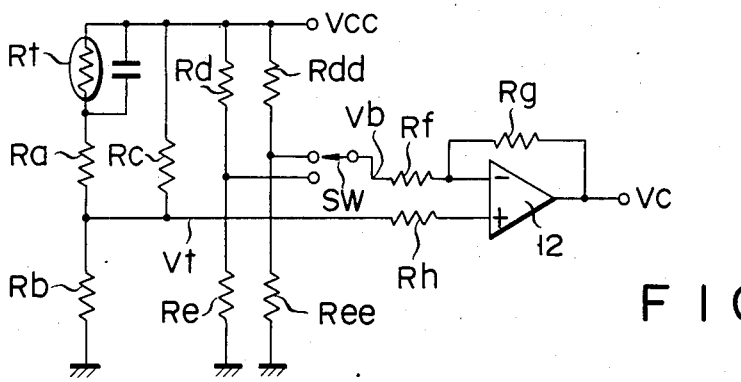
FIG. 7 shows a partial modification of the circuit shown in FIG. 2.

FIG. 7 shows a partial modification of the circuit shown in FIG. 2. According to the modification of FIG. 7, two kinds of reference voltages are provided by two voltage dividers Rd+Re and Rdd+Ree. One of these reference voltages is optionally selected by a switch SW, and the selected one is supplied as voltage Vb to amplifier 12. When two different Vb's are provided, two kinds of target temperatures (Ts) are obtained. Of course, three or more kinds of reference voltages (Vb) may be provided.

Figure 8:
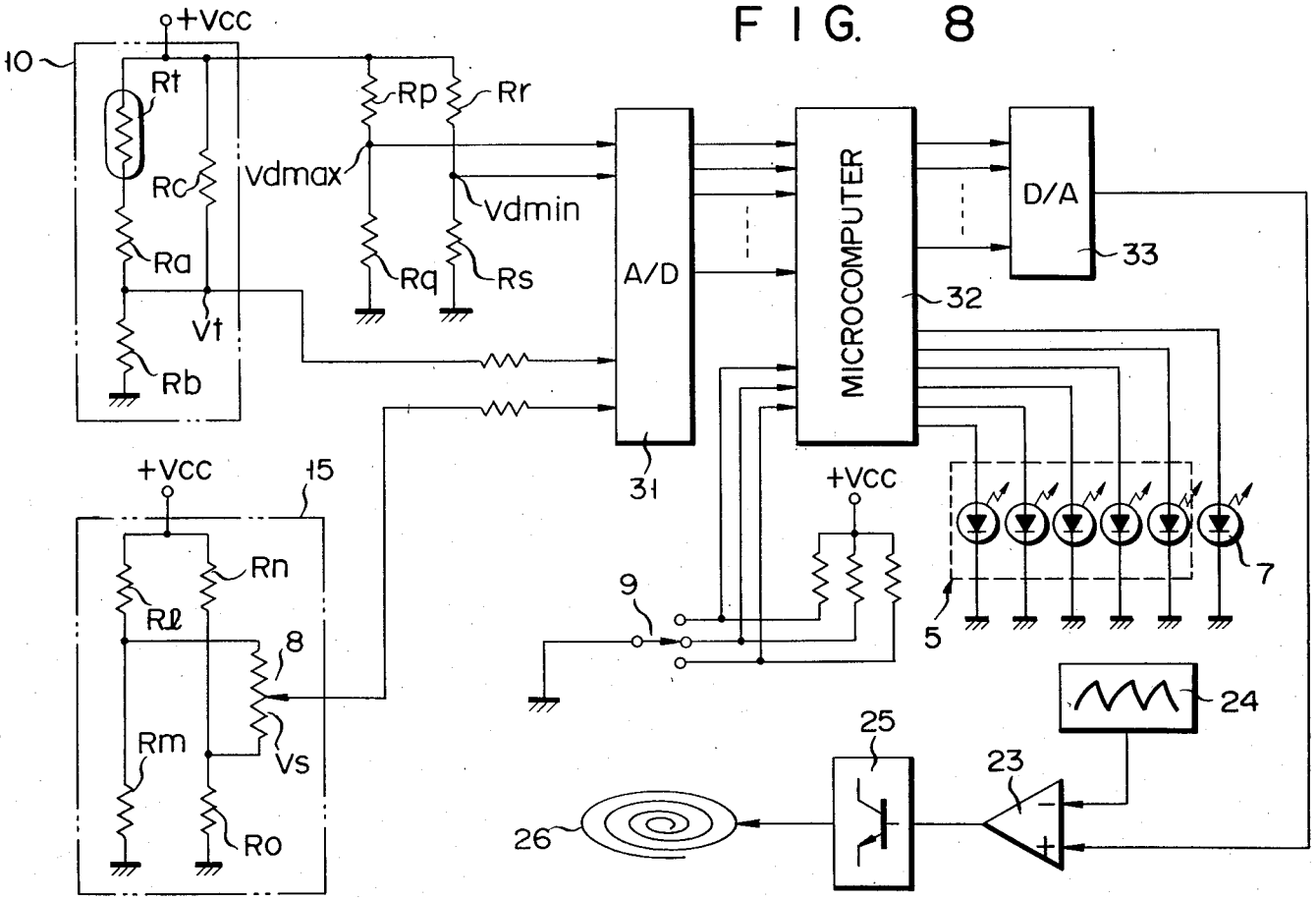
FIG. 8 shows the configuration of a microcomputer-impremented control circuit which is a modification of FIG. 2.

Although an analog circuit of discrete elements is utilized in the above embodiment, the present invention may be embodied by means of a microcomputer as shown in FIG. 8. In the embodiment in FIG. 8, temperature voltage Vt from thermistor circuit 10, temperature set signal Vs from temperature set portion 15, upper limit level Vdmax from the node between Rp and Rq, and lower limit level Vdmin from the node between Rr and Rs are respectively converted into digital data via an A/D converter 31. These digital data are supplied to a microcomputer 32. Microcomputer 32 arithmetically detects the difference between measured temperature Tm and set temperature Ts, and generates a digital signal Vo or E22 corresponding to the difference between Ts and Tm. Vo or E22 obtained from microcomputer 32 is converted via a D/A converter 33 into an analog signal. The converted analog signal is supplied to comparator 23.

Further, microcomputer 32 judges whether or not the detected temperature difference (Ts−Tm) falls within a predetermined range defined by levels Vdmax and Vdmin. The on/off control for optimum temperature indicator LED 7 is performed in accordance with the result of the judgment in microcomputer 32 (cf. FIG. 16).

In the above embodiment, an LED is adapted to the optimum temperature indicator 7, and the on/off of the LED is utilized for an indication of the optimum temperature range of a vessel. However, such an indication may be made by changing the color of the LED, for example. Further, a buzzer, voice generator or the like may be adapted to the optimum temperature indicator 7.

As mentioned above, according to the embodiment of the present invention, it is possible to provide an improved induction heat cooking apparatus which can infallibly inform a cooking apparatus operator whether or not the temperature of a load (vessel) is optimum, and is also possible to maintain a target temperature of the load. Then, good cooking is ensured.

Figure 9:
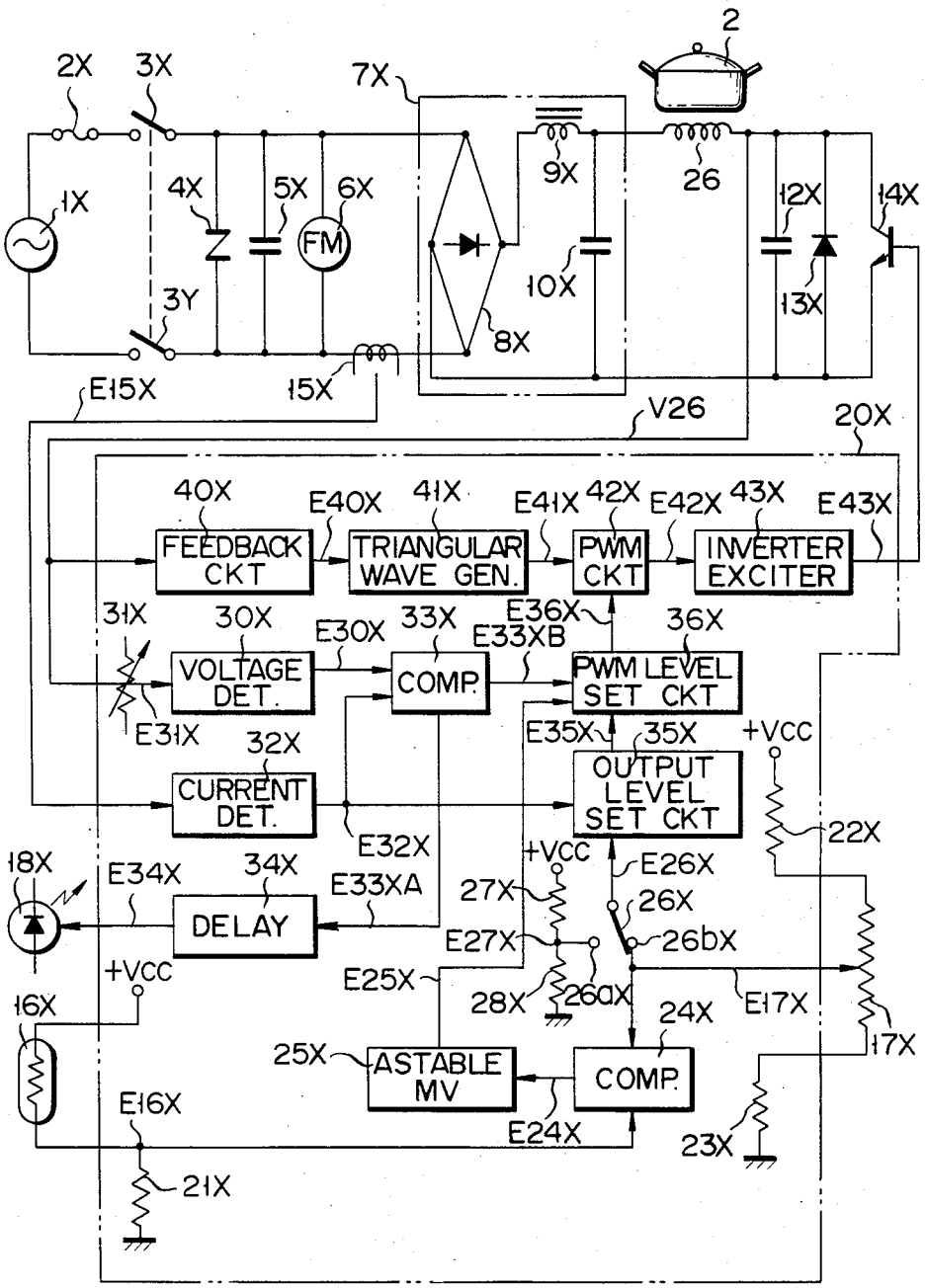
FIG. 9 shows the configuration of a control circuit of another embodiment according to the present invention.

FIG. 9 shows another embodiment of the invention. In FIG. 9, the reference numeral 1X denotes a commercial AC power supply. Power supply 1X is connected via a fuse 2X and power switches 3X, 3Y to a TNR 4X, to a noise suppressing capacitor 5X, to a fan motor 6X for cooling a heating coil 26, and to a rectifier circuit 7X. Rectifier circuit 7X is formed of a diode bridge 8X, a choke coil 9X and a filtering capacitor 10X. The DC output ends of rectifier circuit 7X are coupled to a resonance circuit of heating coil 26 and a capacitor 12X. A damper diode 13X and the collector-emitter path of an NPN transistor 14X are coupled in parallel to capacitor 12X. Rectifier circuit 7X, damper diode 13X and transistor 14X constitute an inverter circuit for exciting or energizing the resonance circuit of elements 26 and 12X.

The AC input side of rectifier circuit 7X is provided with a current transformer 15X. An output voltage E15X from current transformer 15X is supplied to a current detector 32X. Then, current detector 32X provides a signal E32X corresponding to the magnitude of E15X.

A voltage V26 applied to heating coil 26 is supplied via a voltage adjusting resistor 31X to a voltage detector 30X. Resistor 31X is used for adjusting or trimming the value of an input voltage E31X of detector 30X. Voltage detector 30X outputs a signal E30X corresponding to the voltage applied to heating coil 26.

A thermistor 16X shown in FIG. 9 corresponds to thermistor Rt in FIG. 2. Thermistor 16X serves as a temperature sensor thermally coupled to a load (vessel) 2. One end of thermistor 16X is connected to the circuit of a power supply potential +Vcc, and the other end thereof is connected to a circuit-ground via a resistor 21X. The node between thermistor 16X and resistor 21X provides a load (vessel) temperature signal E16X which represents temperature Tm of vessel 2. Signal E16X corresponds to temperature measured signal Vc of FIG. 2.

A temperature set controller 17X shown in FIG. 9 corresponds to temperature set controller 8 in FIG. 2. One end of controller 17X is coupled via a resistor 22X to the circuit of +Vcc, and the other end thereof is circuit-grounded via a resistor 23X. Controller 17X provides a temperature set signal E17X which designates a target or set temperature Ts of vessel 2. Signal E17X corresponds to signal Vs or Vref of FIG. 2.

Signal E16X from thermistor 16X and signal E17X from controller 17X are supplied to a comparator 24X. Comparator 24X compares the potential of E16X with the potential of E17X and generates a switch signal E24X. The logic level of E24X is, e.g., "1" when the vessel temperature Tm represented by E16X is less than the set temperature Ts represented by E17X, while the logic level of E24X becomes, e.g., "0" when the vessel temperature Tm exceeds the set temperature Ts.

Signal E24X is supplied to an astable multivibrator 25X. Multivibrator 25X generates, in accordance with the logic level of E24X, a rectangular wave signal (pulse train) E25X having a given frequency and a given duty cycle (pulse width).

Signal E17X from controller 17X is supplied to a contact **26*b*X of a continuous heating/temperature-adjustable heating selection switch 26X. Contact 26*b*X is provided for selecting the function of temperature-adjustable heating. Switch 26X also has a contact 26*a*X for selecting the function of continuous heating. Contact 26*a*X is connected to one end of each of resistors 27X and 28X. The other end of 27X receives +Vcc, and the other end of 28X is circuit-grounded. The node between resistors 27X and 28X provides a fixed voltage E27X. When continuous heating contact 26*a*X is selected, a selected signal E26X representing the fixed voltage E27X is obtained from switch 26X. When temperature-adjustable heating contact 26*b*X is selected, selected signal E26X representing the signal E17X is obtained from switch 26X**.

Signal E30X from voltage detector 30X and signal E32X from current detector 32X are supplied to a comparator 33X. Comparator 33X compares the potential of E30X with the potential of E32X. Then, comparator 33X generates signals E33XA and E33XB with logic "1" level when a prescribed vessel having a standardized size and being made of inductively heatable material is properly set, or when the load (vessel 2) is proper. Thus, voltage detector 30X, current detector 32X and comparator 33X constitute a load detector.

Signal E33XA from comparator 33X is supplied to a delay circuit 34X. Delay circuit 34X may be a simple CR circuit, and it supplies a delayed output E34X to a load indicator lamp (LED) 18X. LED 18X indicates, in accordance with the signal level of E34X, whether or not a proper load (standard vessel) is set in the cooking apparatus.

Signal E26X from selection switch 26X and signal E32X from current detector 32X are supplied to an output level set circuit 35X. Circuit 35X generates a control signal E35X in accordance with the difference between signal E26X and signal E32X, and circuit 35X controls the output power (heat power) of the cooking apparatus by control signal E35X.

Signal E35X is supplied to a pulse-width-modulation (PWM) level set circuit 36X. Circuit 36X provides a reference signal E36X. Signal E36X is utilized for a pulse-width-modulation which is effected at a PWM circuit 42X. Signal E36X corresponds to signal Vref of FIG. 2 (but is not equal to Vref). The potential of E36X is controlled in accordance with pulse train E25X from multivibrator 25X, signal E33XB from comparator 33X and signal E35X from circuit 35X.

Voltage V26 from heating coil 26 is supplied to a feedback circuit 40X. Circuit 40X generates a pulse signal E40X which is synchronized with the change in voltage V26. Signal E40X is supplied to a triangular (or sawtooth) wave generator 41X. Generator 41X generates a triangular (or sawtooth) wave signal E41X obtained in accordance with the triggering of pulse signal E40X. Signal E41X corresponds to signal E24 of FIG. 2.

Signals E36X and E41X are supplied to PWM circuit 42X which corresponds to comparator 23 in FIG. 2. PWM circuit 42X modulates the pulse-width of E41X with the amplitude of E36X and generates a modulated pulse signal E42X. Signal E42X is supplied to an inverter exciter 43X. Exciter 43X supplies an on/off control signal E43X to the base of transistor 14X in the inverter circuit. Transistor 14X is on/off-controlled by signal E43X corresponding to signal E42X, so that the resonance circuit of heating coil 26 and capacitor 12X is excited.

The circuit elements 21X to 43X constitute a main control portion 20X of the cooking apparatus.

Figure 10:
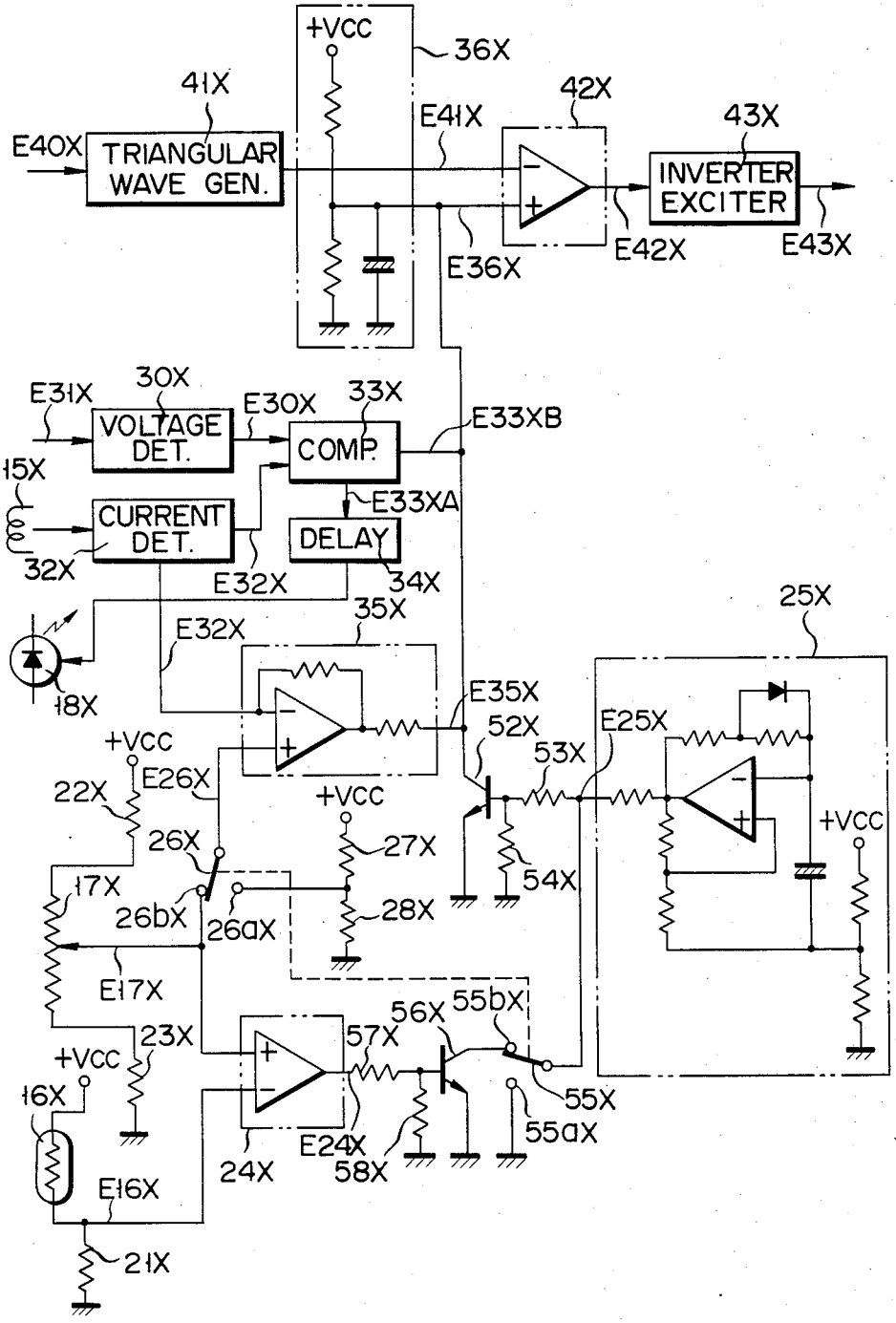
FIG. 10 shows details of several circuit elements in FIG. 9.

FIG. 10 shows details of several circuit elements in FIG. 9. As shown in FIG. 10, the signal E36X line of PWM level set circuit 36X is coupled to the output line of comparator 33X and to the output line of output level set circuit 35X. The output line of circuit 36X is connected to the collector of an NPN transistor 52X. The emitter of transistor 52X is circuit-grounded. Pulse train E25X outputted from astable multivibrator 25X is supplied via a resistor 53X to the base of transistor 52X. The base of transistor 52X is circuit-grounded via a resistor 54X. The output line of a multivibrator 25X is circuit-grounded through a continuous heating contact 55*a*X of a selection switch 55X. Switch 55X may be ganged with said selection switch 26X. The output line of multivibrator 25X is connected via a temperature-adjustable heating contact 55*b*X. of switch 55X to the collector of an NPN transistor 56X. The emitter of transistor 56X is circuit-grounded. The base of transistor 56X receives signal E24X from comparator 24X via a resistor 57X. The base of transistor 56X is circuit-grounded via a resistor 58X.

The circuit operation of the embodiment of FIGS. 9 and 10 will be described with reference to FIGS. 11A to 11E.

Assume that selection switch 26X selects temperature-adjustable heating contact 26*b*X so that the temperature set is made by controller 17X, that selection switch 55X selects temperature-adjustable heating contact 55*b* X so that the signal E25X line is on/off controlled by transistor 56X and power switches 3X and 3Y are turned-on under the proper setting of vessel 2 on the top plate (3 in FIG. 1A).

Then, inverter exciter 43X is actuated so that the resonance circuit of heating coil 26 and capacitor 12X starts to oscillate. The oscillation of the resonance circuit causes a high frequency current to flow into heating coil 26. At this time, the amount of a current inputted to rectifier circuit 7X is detected by current detector 32X, and the magnitude of a voltage applied to heating coil 26 is detected by voltage detector 30X. When a standard vessel is properly set in the cooking apparatus, a comparator 33X outputs signals E33XA and E33XB having a logic "1" level. Logic "1" signal E33XA from comparator 33X turns on the load indicator LED 18X with a slight time-delay in the delay circuit 34X. On the other hand, since it is assumed that switch 26X selects contact 26*b*X, circuit 35X is responsive to signal E17X from controller 17X and signal E32X from current detector 32X. Then, circuit 35X supplies signal E36X line with signal E35X which corresponds to the difference between E17X and E32X.

Signal E17X designating set temperature Ts and signal E16X representing vessel temperature Tm are compared in comparator 24X. When vessel temperature Tm is lower than set temperature Ts (t10 to t12 in FIG. 11A), comparator 24X outputs logic "1" signal E24X (t10 to t12 in FIG. 11B). When the logic level of signal E24X is "1," transistor 56X is turned-on so that the signal E25X line of multivibrator 25X is circuit-grounded, thereby retaining the "off" of transistor 52X.

When logic "1" signal E33XB is obtained from comparator 33X under the turn-off of transistor 52X, reference signal E36X with a certain potential is supplied from PWM level set circuit 36X to PWM circuit 42X. The potential of E36X depends on the potential of E35X from output level set circuit 35X. PWM circuit 42X modulates the width of triangular wave signal E41X from generator 41X in accordance with the potential of E36X. According to this pulse-width-modulation, inverter exciter 43X excites the inverter circuit. Then, the oscillation of the resonance circuit is performed so that a certain amount of high frequency current continuously flows into heating coil 26. Namely, the heating starts.

Figures 11A, 11B, 11C, 11D, 11E:
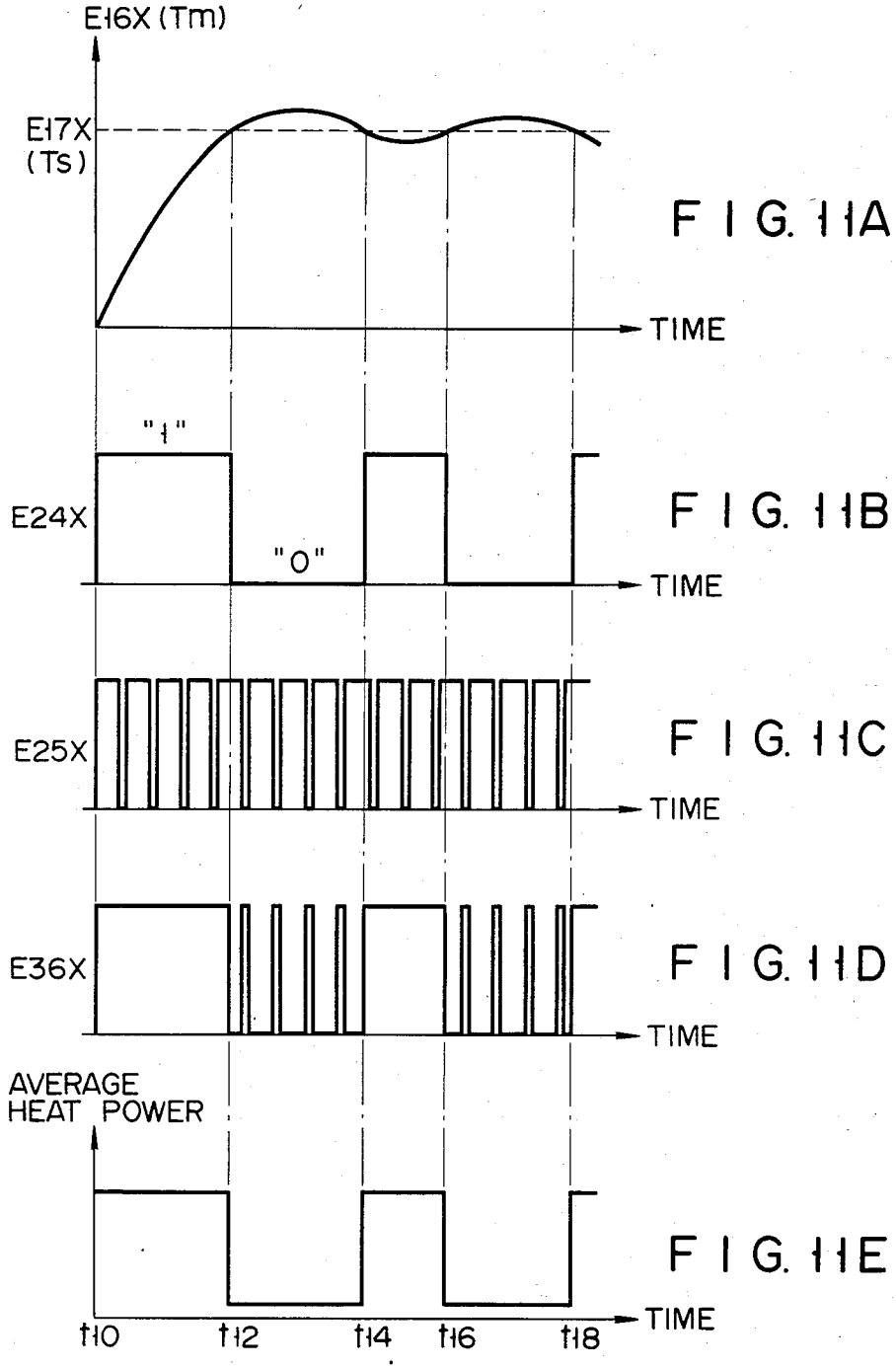
FIGS. 11A to 11E show graphs explaining a typical operation of the apparatus in FIG. 9.

After the heating starts, vessel temperature Tm is increased (after t10 in FIG. 11A). When vessel temperature Tm exceeds set temperature Ts (after t12 in FIG. 11A), the logic level of E24X from comparator 24X is changed from "1" to "0" (t12 in FIG. 11B), and transistor 56X is turned-off. When transistor 56X is turned-off, transistor 52X starts to perform on/off switching according to signal (pulse train) E25X from multivibrator 25X (FIG. 11C). Then, the signal E36X line is intermittently circuit-grounded by the intermittent "on" of transistor 52X, and pulsate reference signal E36X is supplied to PWM circuit 42X (after t12 in FIG. 11D). From this, the inverter circuit is intermittently actuated so that a non-continuous oscillation of the resonance circuit is effected only during the period of each pulse width of pulsate signal E36X. In this case, the period of each intermittent actuation of the inverter circuit is so determined by the circuit constants of astable multivibrator 25X that the load detector (30X to 33X) can infallibly detect the condition of load (vessel) 2. During the intermittent actuation period, the resonance circuit performs the oscillation, and heating is effected. However, heating only during this period is substantially equivalent to the interruption of heating, because the average heat power during this intermittent actuation is selected to be sufficiently small (t12 to t14 in FIG. 11E).

During the intermittent actuation of the inverter circuit, when a standard vessel is properly set, comparator 33X of the load detector outputs pulsate logic "1" signals E33XA and E33XB for each intermittent actuation of the inverter circuit. In this case, since delay circuit 34X is interposed between comparator 33X and LED 18X, LED 18X is not alternatively turned on and off by pulsate signal E33XA, but it is continuously turned on. From the "on" of LED 18X, the fact that a standard vessel is properly set is informed to the cooking apparatus operator.

If a standard vessel 2 is removed from top plate 3 (FIG. 1A) or a standard vessel 2 is replaced with a nonstandard one during the intermittent actuation of the inverter circuit, such an erroneous state is detected by the load detector (30X to 33X) and the logic level of each of E33XA and E33XB is change from "1" to "0." Then, LED 18X is turned off by the logic "0" of E33XA slightly after the time of the logic level change. Thus, non-setting or improper setting of vessel 2 is informed to the cooking apparatus operator by the "off" of LED 18X. Further, when signal E33XB from comparator 33X becomes logic "0," the signal E36X line of PWM level set circuit 36X is circuit-grounded. Then, the actuation of the inverter circuit is forcibly inhibited so that the oscillation of the resonance circuit is stopped.

When vessel temperature Tm falls below set temperature Ts (t14 to t16 in FIG. 11A) due to the inhibition of heating (or due to the intermittent oscillation of the resonance circuit), signal E24X from comparator 24X becomes logic "1" (t14 to t16 in FIG. 11B). In this case, transistor 56X is turned on so that transistor 52X is turned off. Then, the inverter circuit performs continuous oscillation, i.e., the effective heating again starts (t14 to t16 in FIGS. 11D and 11E).

When vessel temperature Tm again exceeds set temperature Ts (t16 to t18 in FIG. 11A) by the above heating (or by the continuous oscillation of the resonance circuit), signal E24X again becomes logic "0" (t16 to t18 in FIG. 11B). In this case, the inverter circuit stops the continuous oscillation while it performs the intermittent oscillation, i.e., the heating is again inhibited (t16 to t18 in FIGS. 11D and 11E).

As mentioned above, in temperature-adjustable cooking, the inverter circuit is continuously excited when the vessel temperature is lower than the set temperature. On the other hand, when the vessel temperature is higher than the set temperature, the inverter circuit is intermittently excited within a given fixed period which is required for ensuring the load detection by the load detector. Accordingly, the load detection is always effected to achieve an infallible indication of the proper setting or improper setting of the load.

According to the above embodiment of the present invention, it is possible to obtain a reliable induction heat cooking apparatus in which a heat control is performed based on a comparison between a load (vessel) temperature and a set temperature, wherein a correct load detection is always executed independently of the function of temperature adjustment.

Although the above embodiment is constituted by discrete circuit elements, the present invention may be similarly reduced to practice by means of a program control using a microcomputer.

In addition, the indication of a proper setting or improper setting of a load may be made by a buzzer or other similar indicators, instead of using an LED.

Figure 12:
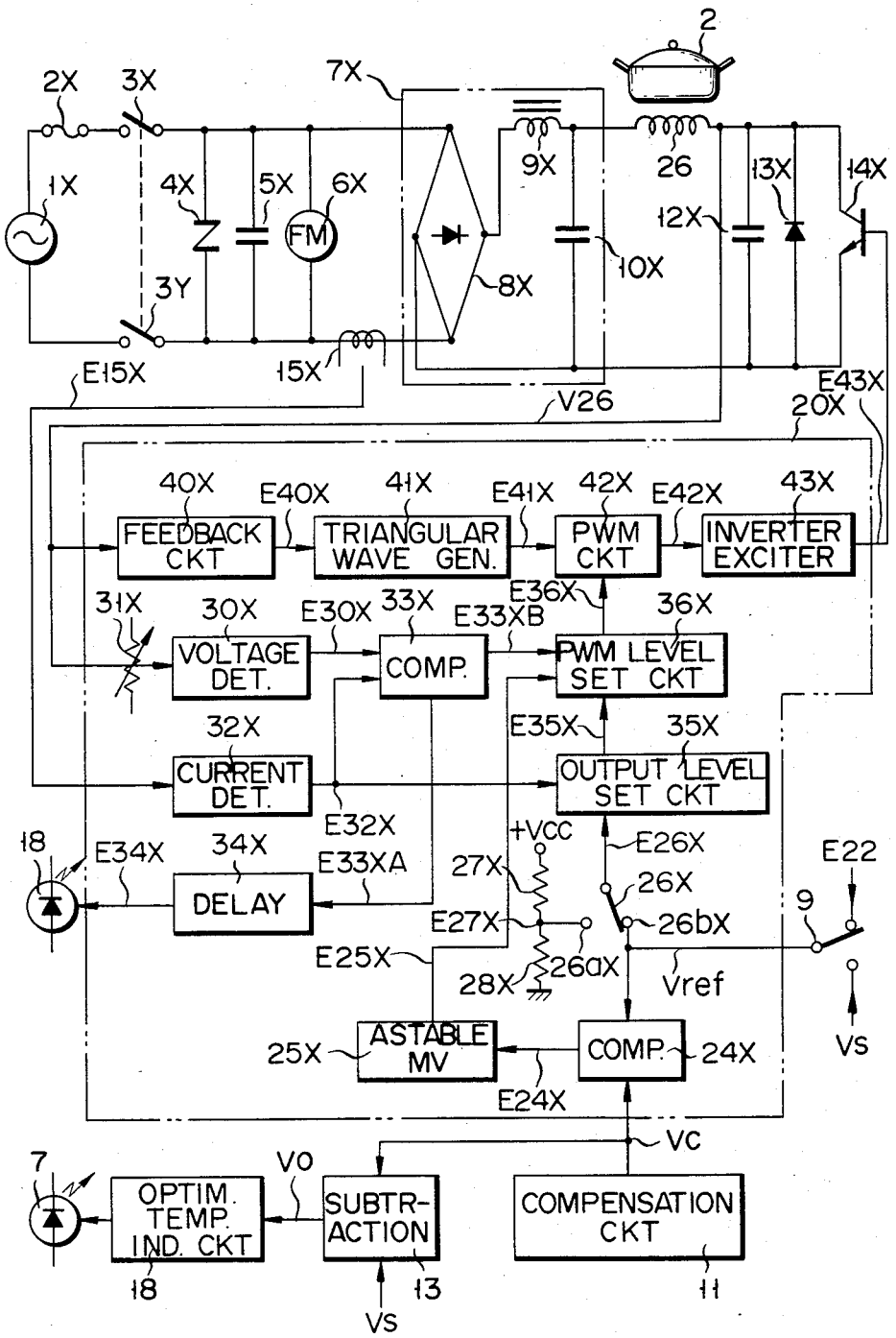
FIG. 12 shos the configuration of a control circuit of another embodiment which corresponds to the combination of the embodiments of FIGS. 2 and 9.

FIG. 12 shows the configuration of a control circuit of another embodiment which corresponds to the combination of the embodiments of FIGS. 2 and 9. In the FIG. 12 embodiment, comparator 24X receives signals Vref and Vc in place of signals E17X and E16X, respectively. The FIG. 12 embodiment has functions of the heat power control (FIG. 5A), the optimum temperature indication (FIG. 5D) and the load detection even at the interruption of effective heating (t12–t14 in FIG. 11E).

FIGS. 13A-1 to 13C-2 jointly show a detailed circuit diagram of another embodiment of the invention. The FIG. 13 embodiment also corresponds to the combination of FIGS. 2 and 9. This embodiment is one of best modes contemplated by the inventor.

Figures 1, 13A:
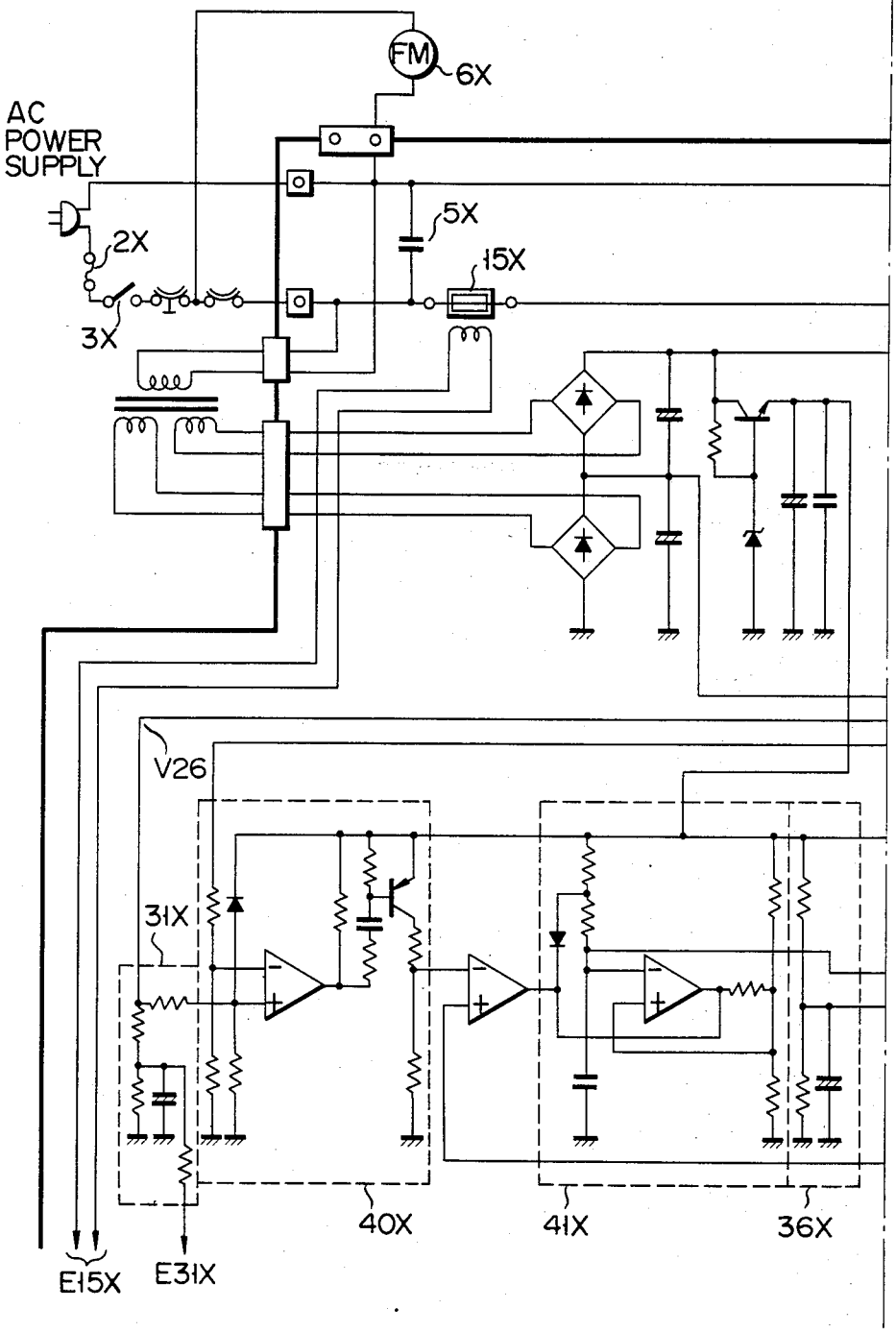
Figures 2, 13A:
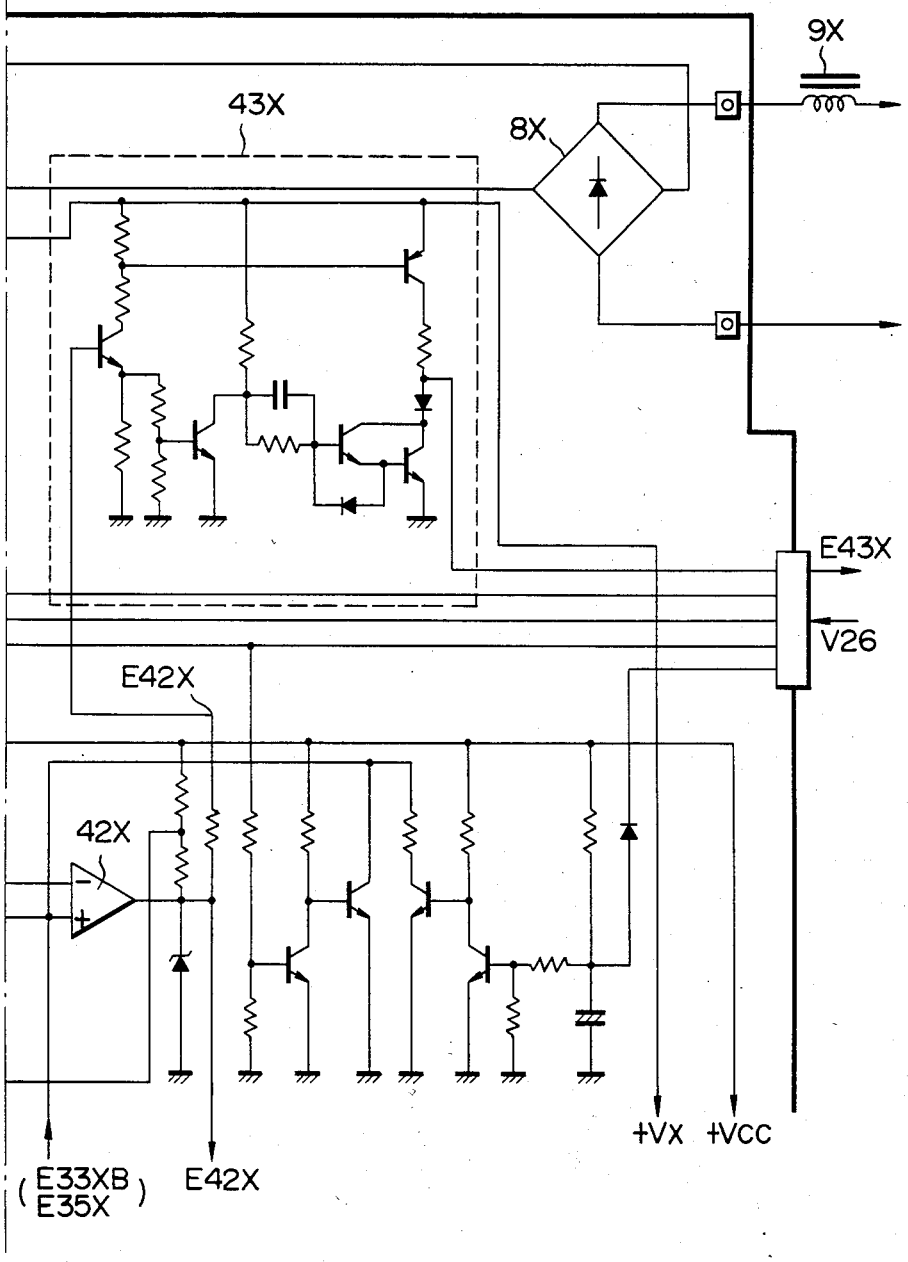
Figures 1, 13B:
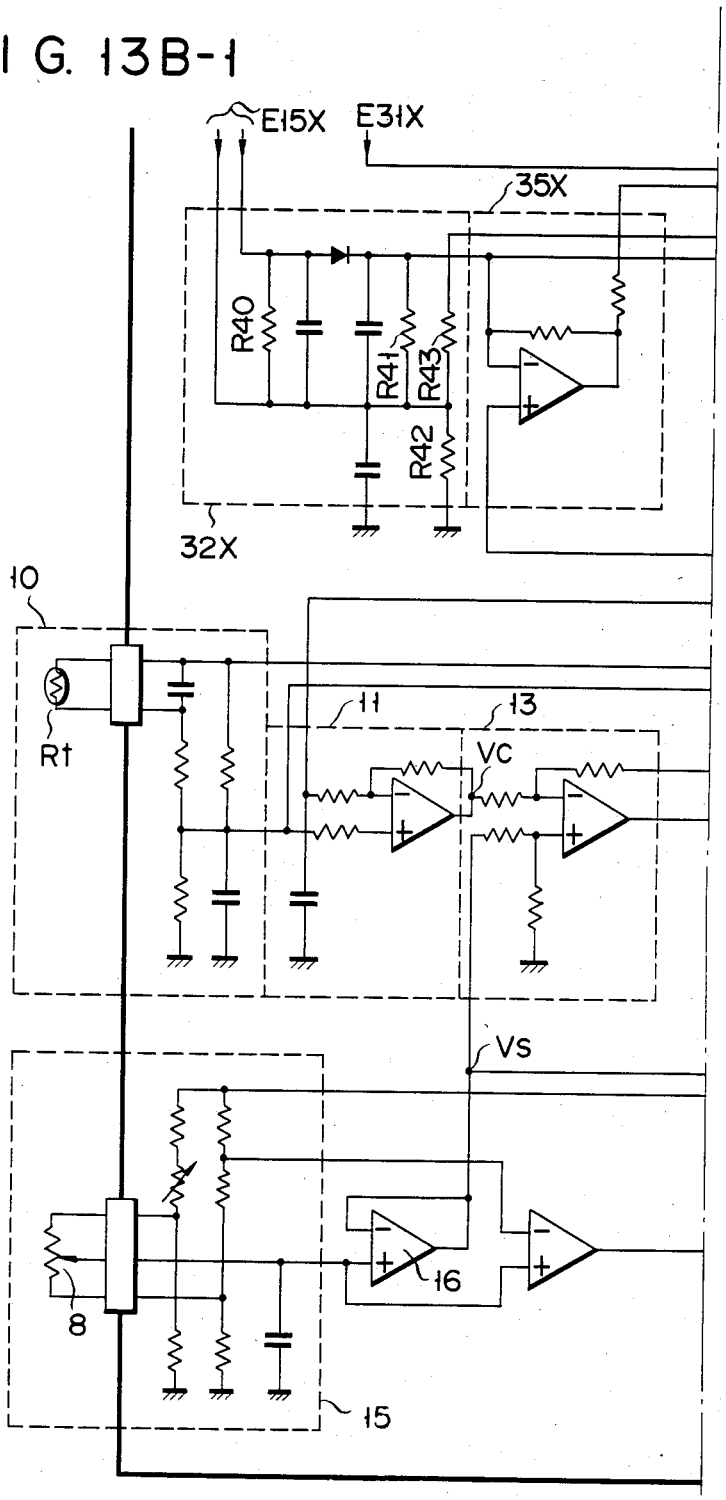
Figures 2, 13B:
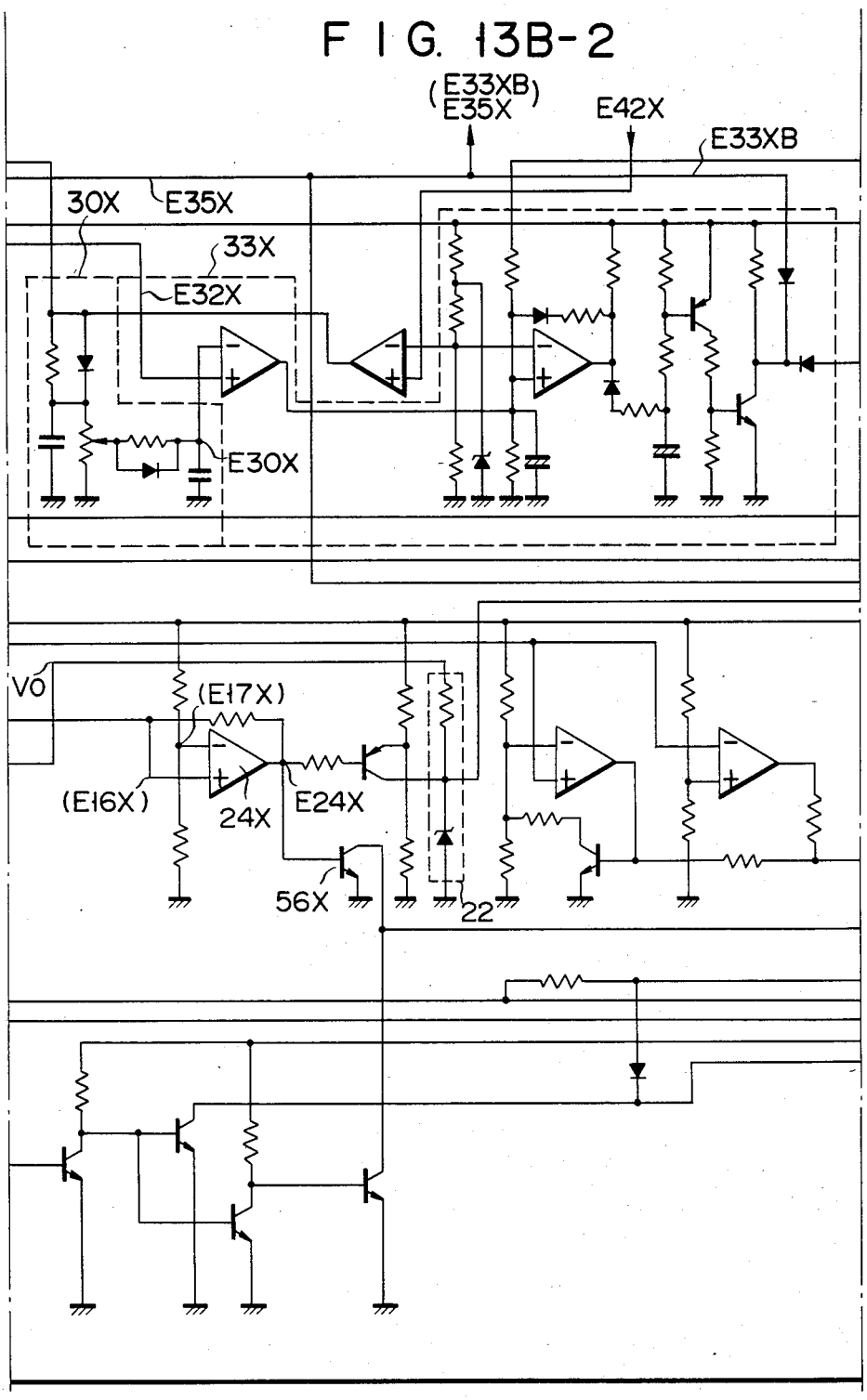
Figures 3, 13B:
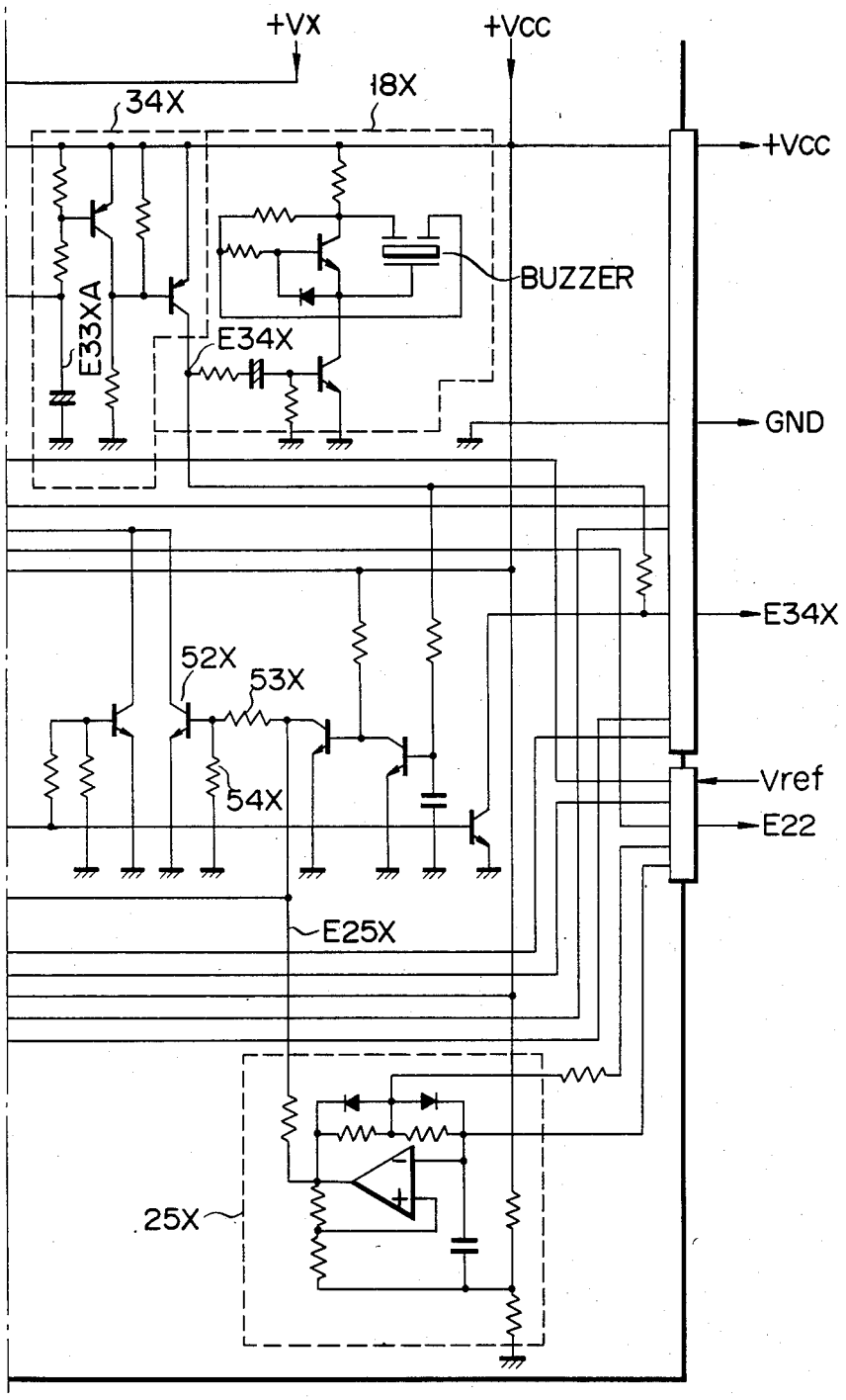
Figures 1, 13C:
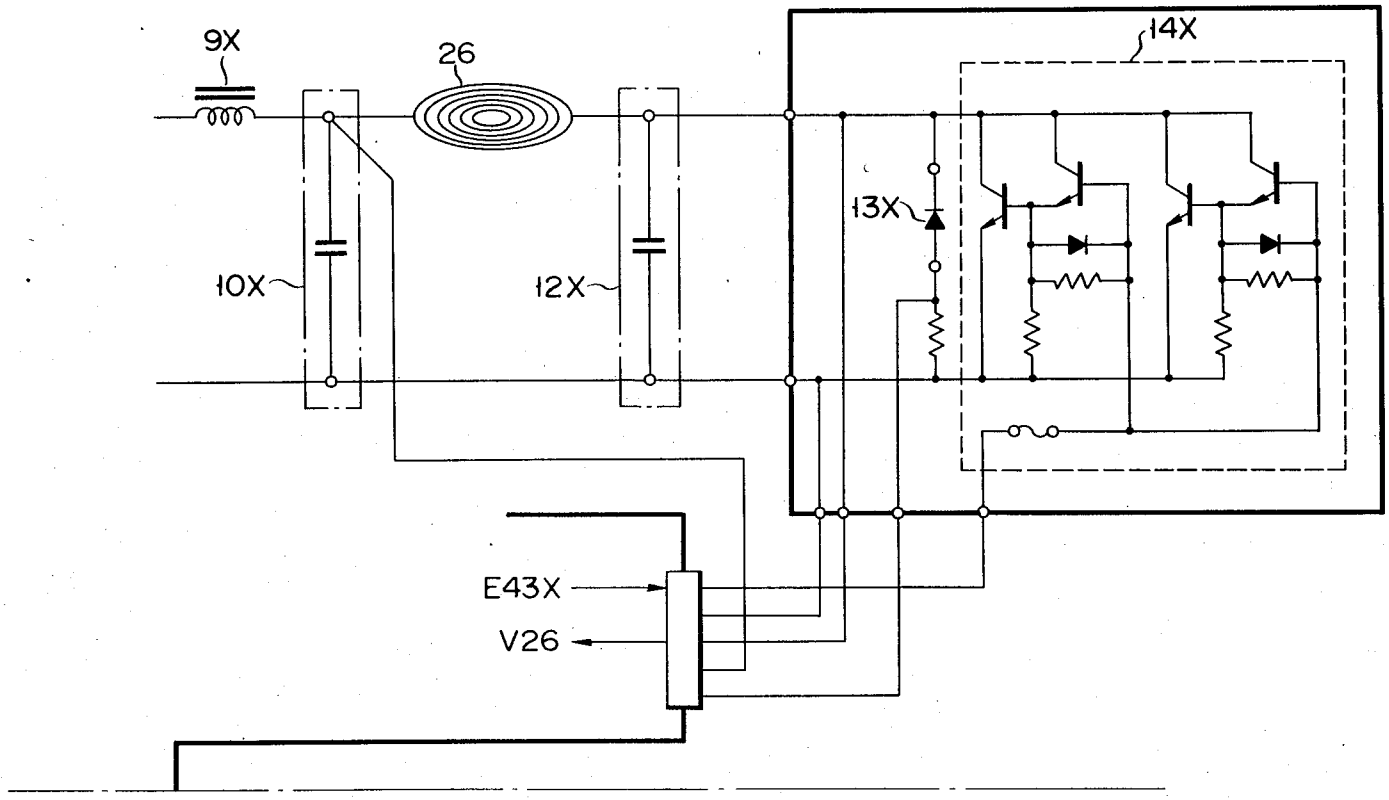
Figures 2, 13C:
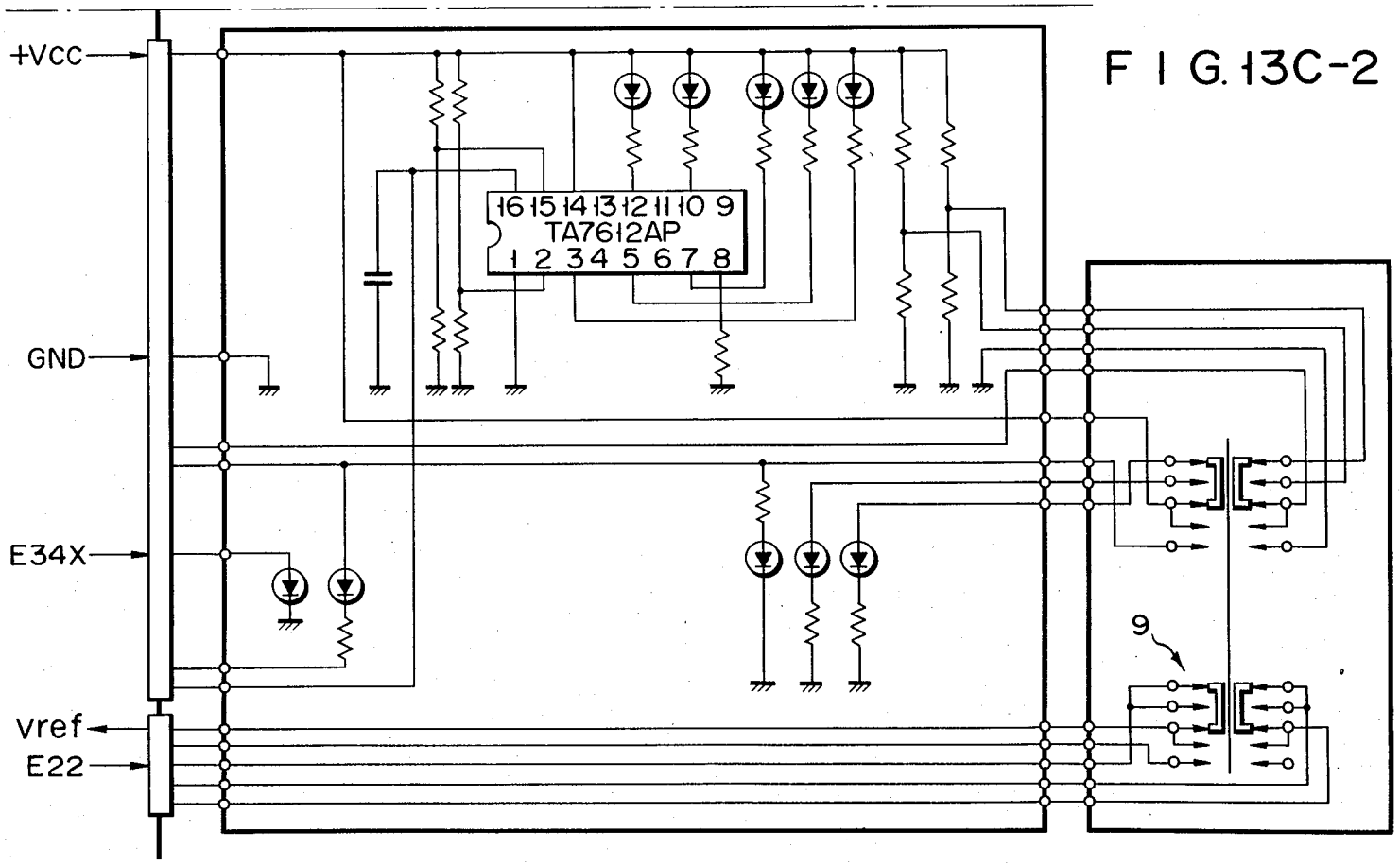
Figure 14A:
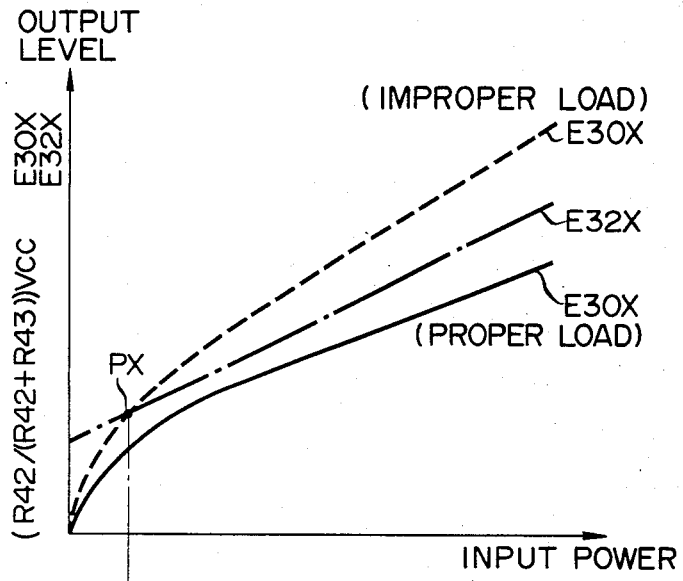
FIGS. 14A to 14C show graphs explaining a load detecting operation of the apparatus in FIGS. 13A to 13C.
Figure 14B:
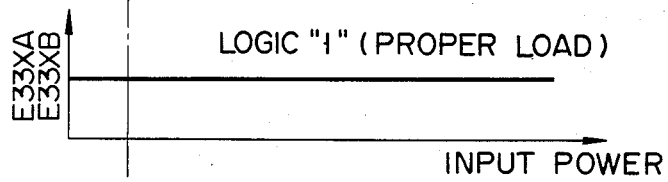
Figure 14C:
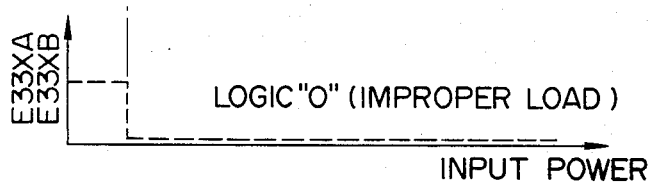

FIGS. 14A to 14C show graphs explaining a load detecting operation of the apparatus in FIGS. 13A to 13C. As shown in FIG. 14A, the level of signals E30X and E32X is increased as the input power of heating coil 26 increases. According to the configuration of FIGS. 13A to 13C, when a standard vessel (proper load) is properly set on the cooking apparatus, the level of E30X always falls below the level of E32X and comparator 33X generates a logic "1" signals E 33 XA and E 33 XB (FIG. 14B). If an improper load is set on the cooking apparatus, the level of E30X exceeds the level of E32X (point PX in FIG. 14A), and comparator 33X generates logic "0" signals E33XA and E33XB (FIG. 14C). The reason why the curve of E30X is varied according to the state of the load is that the impedance of heating coil 26 depends on the material, size and/or the setting state of vessel 2. According to the logic level of signals E33XA and E33XB, the load detection is achieved.

Figure 15:
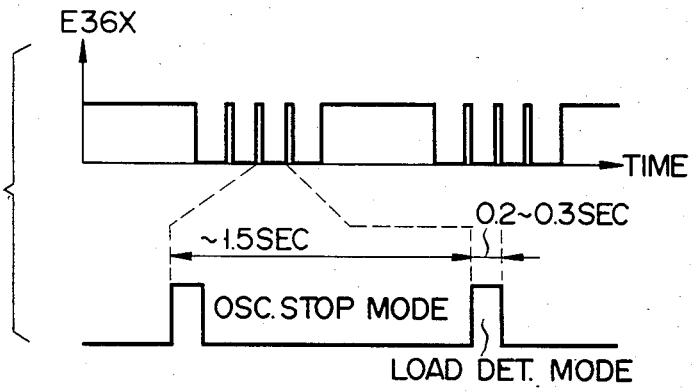
FIG. 15 shows a waveform expandingly illustrating a part of a signal E36X(FIG. 11D)

FIG. 15 shows a waveform expandingly illustrating a part of a signal E36X. As shown at the under side of FIG. 15, the period of the pulse component of signal E36X may be about 1.5 seconds, and the pulse width of each pulse component may be about 0.2 to 0.3 seconds. The load detection at the heating inhibited period (t12 to t14, etc., in FIGS. 11D and 11E) is carried out during such a 0.2 to 0.3 second period.

Figure 16:
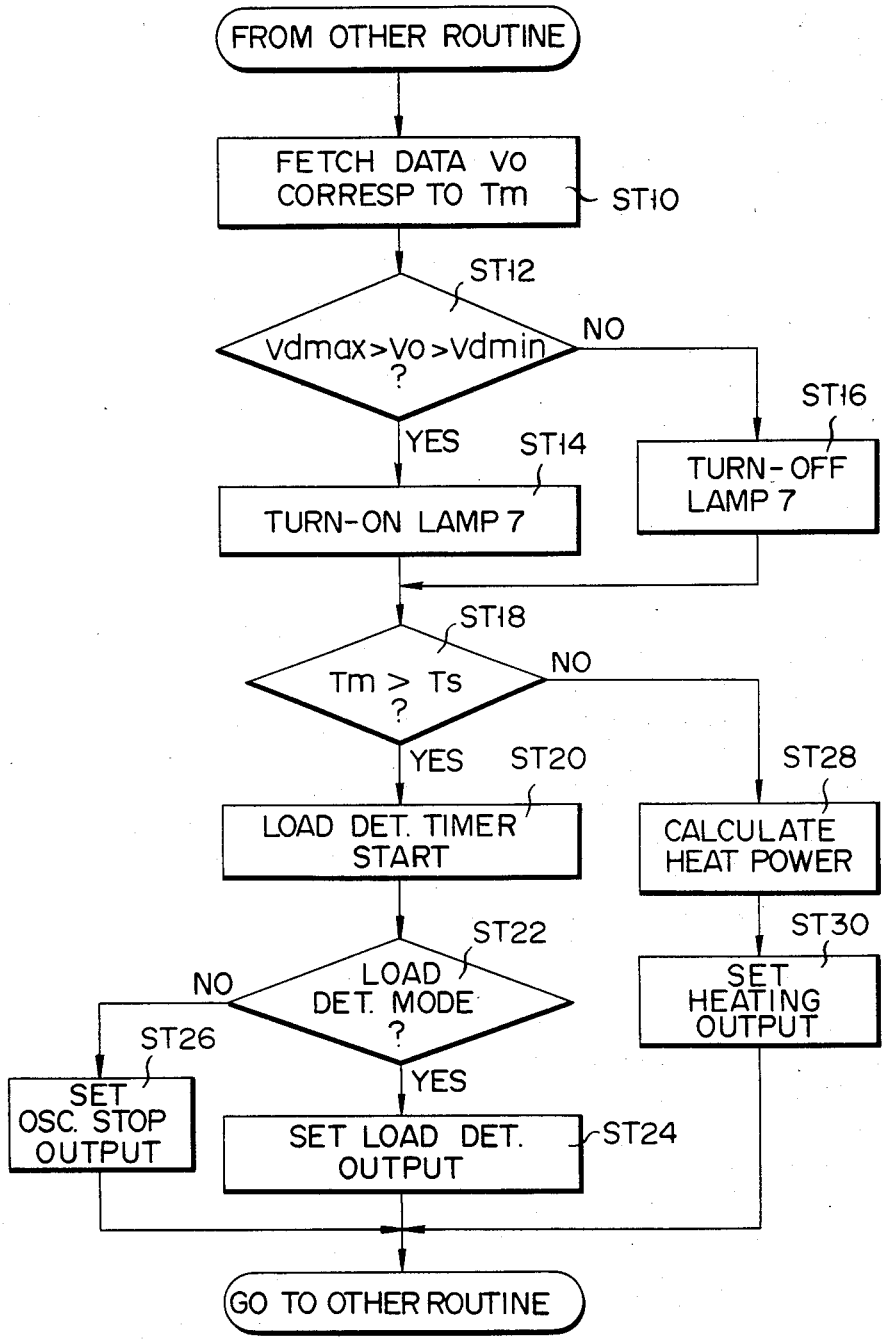
FIG. 16 shows a flow chart explaining the main function of a microcomputer 32 in FIG. 8.

FIG. 16 shows a flow chart explaining the key function of microcomputer 32 in FIG. 8. Thus, FIG. 16 shows a sequence of the on/off control for lamp (LED) 7 and shows how to control the output power for heating coil 26. First, microcomputer 32 fetches digital data Vo representing the measured temperature Tm (step ST10). Data Vo corresponds to the difference between Vt and Vs. Microcomputer 32 is responsive to data Vo, Vdmax and Vdmin. When the relation Vdmax >Vo >Vdmin is satisfied (YES in step ST12), lamp 7 is turned-on (step ST14), thereby the optimum temperature being indicated. When the relation Vdmax >Vo >Vdmin is not established (NO in step ST12), lamp 7 is turned-off (step ST16). In this case, the cooking apparatus operator is informed that the temperature of vessel 2 drops out of the optimum temperature range (e.g., Tm(min) to Ts in FIG. 5B).

Microcomputer 32 is responsive to either data Vt or Vo representing the measured temperature Tm and to data Vs representing the target temperature Ts. Microcomputer 32 judges whether or not a relation Tm >Ts has been satisfied (step ST18). When the relation Tm >Ts is satisfied (YES in step ST18), a load detection timer (counter) in microcomputer 32 starts to operate (step ST20). The load detection timer defines the load detection interval and the load detection mode period (e.g., 1.5 seconds and 0.2 to 0.3 seconds, respectively, as shown in FIG. 15). The start of this timer is controlled by microcomputer 32, but the timer operation is independent of the operational clock of microcomputer 32.

Next, microcomputer 32 judges, in accordance with the contents of the load detection timer, whether or not the control sequence is in the load detection mode (step ST22). When the load detection mode has been established (YES in step ST22; 0.2 to 0.3 seconds period in FIG. 15), microcomputer 32 sets an output for effecting the load detection (step ST24). When the load detection mode is not established (NO in step ST22; 1.5 seconds period in FIG. 15), microcomputer 32 sets an output for stopping the oscillation (step ST26).

When the relation Tm >Ts is not established (NO in step ST18), the magnitude of heat power is calculated according to the difference between Vt (Tm) and Vs (Ts) (step ST28). Then, microcomputer 32 sets an output for heating the load (step ST30).

After completion of the control sequence in FIG. 16, microcomputer 32 goes on to perform another routine.

The present invention should not be limited to the embodiment disclosed herein. This invention, of course, may be embodied in various ways without departing from the scope of the invention as claimed.

The following U.S. patents relate to the technical field of the invention. All disclosures of these U.S. patents are incorporated in the present application for the purpose of assisting the disclosure of the present invention.

(1) U.S. Pat. No. 3,966,426 issued on June 29, 1976 (McCoy et al.)
(2) U.S. Pat. No. 1,900,842 issued on Mar. 7, 1933 (Northrup)
(3) U.S. Pat. No. 4,013,859 issued on Mar. 22, 1977 (Peters, Jr.)
(4) U.S. Pat. No. 4,356,371 issued on Oct. 26, 1982 (Kiuchiet al.)
(5) U.S. Pat. No. 4,354,082 issued on Oct. 12, 1982 (Tellert et al.)
(6) U.S. Pat. No. 3,781,505 issued on Dec. 25, 1973 (Steigerwald ).

What is claimed is:

1. An induction heat cooking apparatus, comprising:
a heating coil for providing an electromagnetic field, when excited to inductively heat a load;
exciter means for exciting said heating coil to cause variable amount of heating power to be output therefrom;
temperature setting means for providing a temperature set signal which designates a desired target temperature of said load;
temperature measuring means for measuring a temperature of said load to generate a temperature measure signal indicative thereof; and
difference detector means, coupled to said temperature measuring means, said temperature setting means and said exciter means, for detecting a difference between said temperature set signal and said temperature measure signal and generating a difference signal indicative of said difference, and for supplying a difference signal to said exciter means to control the degree of excitation thereof, said heating power for said heating heating coil being continuously controlled to variable power levels in accordance with said difference signal so that said heating power is maintained at a first constant power level until said load temperature reaches a first value, and said heating power is then decreased at a definite rate until said load temperature reaches a second value greater than said first value, said rate being less than infinity to cause said heating power to gradually decrease as a function of time, so that when said load temperature approaches said set temperature, said heating power has been lowered from said first constant level, and therefore a rate of temperature increase of the load has been lowered to thereby maintain said load temperature close to said set temperature by varying said heating power to minimize an amount of temperature overshoot.

2. An induction heat cooking apparatus according to claim 1, further comprising:
judging means, coupled to said difference detector means, for judging whether said the value of said difference signal falls within a predetermined range of values; and
means for indicating the result of the judgment.

3. An induction heat cooking apparatus according to claim 2, wherein said difference detector means includes comparator means being responsive to a given comparison signal, for comparing said difference signal with said given comparison signal, and reducing said heat power when the magnitude of said difference signal corresponds to said given comparison signal, thereby substantially avoiding a temperature increase of said load above said desired target temperature.

4. An induction heat cooking apparatus according to claim 1, wherein said difference detector means includes comparator means, being responsive to a given comparison signal, for comparing said difference signal with said given comparison signal, and reducing said heat power when the value of said difference signal is within a predetermined range around said given comparison signal, thereby substantially avoiding a temperature increase of said load above said desired target temperature.

5. An induction heat cooking apparatus according to claim 1, wherein said temperature measuring means includes:
temperature to voltage converter means, thermally coupled to said load, for converting the measured temperature of said load to a temperature voltage; and
circuit means, coupled to said temperature/voltage converter means and being responsive to a given reference voltage, for generating said temperature measure signal in accordance with the difference between said temperature voltage and said reference voltage.

6. An induction heat cooking apparatus according to claim 5, wherein said temperature measure means includes voltage source means for generating a plurality of fixed voltages, and one of the plural fixed voltages is used for said given reference voltage.

7. An induction heat cooking apparatus according to claim 1, wherein said difference detector means includes program control means being implemented by a microcomputer for providing data corresponding to said difference signal.

8. An induction heat cooking apparatus comprising:

a resonance circuit of a heating coil and capacitor for generating an electromagnetic field for supply to a load so that the load is indictively heated;

inverter means for driving said resonance circuit so that the electromagnetic field is generated;

temperature setting means for providing a temperature set signal which designates a given target temperature of the load;

temperature sensor means for sensing a temperature of the load to generate a load temperature signal; and actuator means, coupled to said inverter means, said temperature setting means, and said temperature sensor means, for comparing said load temperature signal with said temperature set signal, and actuating said inverter means in accordance with the results of the comparison, so that (1) said inverter means intermittently energizes said resonance circuit when the temperature of said load is higher than said given target temperature, and (2) said inverter means continuously energizes said resonance circuit when the temperature of said load is lower than said given target temperature, said actuator means including load detector means, coupled to said resonance circuit, for generating a load condition signal by comparing the magnitudes of a voltage and current applied to said resonance circuit; and indicator means, coupled to said load detector means, for indicating whether a proper load is set.

9. An induction heat cooking apparatus according to claim 8, wherein the condition that the temperature of said load is higher than said given target temperature represents a condition that said load temperature signal corresponds to said temperature set signal, and wherein the condition that the temperature of said load is lower than said given target temperature represents a condition that said load temperature signal does not correspond to said temperature set signal.

10. An induction heat cooking apparatus according to claim: 8, wherein said load detector means includes:

voltage detector means, coupled to said resonance circuit, for detecting a voltage of said heating coil to generate a voltage signal;

current detector means, coupled to said resonance circuit, for detecting a current of said heating coil to generate a current signal; and condition detector means, coupled to said voltage detector means and to said current detector means, for detecting in accordance with said voltage and current signals a condition that a proper load is placed in the induction heat cooking apparatus, and generating said load condition signal.

11. An induction heat cooking apparatus according to claim 8, wherein said actuator means includes:

comparator means, coupled to said temperature set means and to said temperature sensor means, for comparing said load temperature signal with said temperature set signal, and generating a switch signal when said load temperature signal corresponds to said temperature set signal;

pulse generator means for generating a pulse train having a given pulse width; and gate circuit means, coupled to said comparator means and to said pulse generator means, for providing a power control signal which has a pulsate signal component corresponding to said pulse train and serves to effect the intermittent energization of said resonance circuit when said switch signal is generated, the pulse width of said pulsate signal component being selected such that said load detector means is enabled to generate said load condition signal during the period of the pulse width of said pulsate signal component.

12. An induction heat cooking apparatus according to claim 8 actuator means includes:

comparator means, coupled to said temperature set means and to said temperature sensor means, for comparing said load temperature signal with said temperature set signal, and generating a switch signal when said load temperature signal corresponds to said temperature set signal;

pulse generator means for generating a pulse train having a given pulse width;

gate circuit means, coupled to said comparator means and to said pulse generator means, for providing a power control signal which has a pulsate signal component corresponding to said pulse train and serving to effect the intermittent energization of said resonance circuit when said switch signal is generated, the pulse width of said pulsate signal component being selected such that said load detector means is enabled to generate said load condition signal during the period of the pulse width of said pulsate signal component.

13. An induction heat cooking apparatus according to claim 8, wherein said actuator means includes program control means being implemented by a microcomputer for performing the comparing and actuating operation of said actuator means.

14. An induction heat cooking apparatus in which an electromagnetic field is generated from a resonance circuit of a heating coil and capacitor, and the generated electromagnetic field is supplied to a load so that the load is inductively heated, said cooking apparatus comprising:

inverter means for energizing said resonance circuit so that said electromagnetic field is generated;

temperature set means for providing a temperature set signal which designates a given target temperature of said load;

temperature measure means for measuring temperature of said load to generate a temperature measure signal which represents the measured temperature of said load;

difference detector means, coupled to said temperature measure means and to said temperature set means, for detecting a difference between said temperature set signal and said temperature measure signal to generate a difference signal;

actuator means, coupled to said inverter means, said difference detector means, and said temperature measure means, for comparing said temperature measure signal with said difference signal, and selectively actuating said inverter means, so that said inverter means intermittently energizes said resonance circuit when the temperature of said load is higher than said given target temperature, and said inverter means continuously energizes said resonance circuit when the temperature of said load is lower than said given target temperature;

load detector means, coupled to said resonance circuit, for generating a load condition signal in accordance with a comparison between the magnitudes of a voltage and current applied to said resonance circuit; and indicator means, coupled to said load detector means, for indicating in accordance with said load condition signal whether or not a proper load is set.

15. An induction heat cooking apparatus according to claim 14, further comprising:

judge/indicator means, coupled to said difference detector means, for judging whether said difference signal falls within a predetermined range and for indicating this result.

16. An induction heat cooking apparatus comprising:

a heating coil for providing, when excited, an electromagnetic field to inductively heat a load;

exciter means for exciting said heating coil;

temperature setting means for providing a temperature set signal which designates a desired target temperature of the load;

temperature measuring means for measuring a temperature of the load to generate a temperature measure signal indicative thereof;

difference detector means, coupled to said temperature measure means, said temperature setting means and said exciter means, for detecting a difference between said temperature set signal and said temperature measure signal to generate a difference signal indicative of such difference, and supplying said difference signal to said exciter means to control the degree of excitation thereof so that heat power for said heating coil is continuously controlled in accordance with said difference signal; and limiter means within said difference detector means for limiting the maximum magnitude of said difference signal that can be supplied to said exciter means, so that the upper limit of heat power for said heating coil is restricted to a predetermined maximum value.

17. An induction heat cooking apparatus in which an electromagnetic field generated by a heating coil is supplied to a load so that the load is inductively heated, said cooking apparatus comprising:

exciter means for exciting said heating coil to generate said electromagnetic field;

temperature setting means for providing a temperature set signal which designates a desired target temperature of said load;

temperature measuring means for measuring a temperature of said load to generate a temperature measure signal indicative thereof; and difference detector means, coupled to said temperature measuring means, said temperature setting means and said exciter means, for detecting a difference between said temperature set signal and said temperature measure signal and generating a difference signal indicative of said difference, said difference signal being coupled to said exciter means to control the degree of excitation thereof so that heat power for said heating coil is continuously controlled in accordance with said difference signal, including selector means, coupled to said temperature setting means, for selecting either one of said difference signal and said temperature set signal, and supplying the selected signal to said exciter means so that the heat power for said heating coil is controlled in accordance with said selected signal.

18. An induction heat cooking apparatus according to claim 17, wherein said heating coil is combined with a capacitor to form a resonance circuit, and wherein said exciter means includes:

signal generator means for generating a sawtooth-wave signal;

modulator means, coupled to said signal generator means and to said selector means, for pulse-width-modulating said sawtooth-wave signal according to the selected one of said difference signal and temperature set signal, and providing a pulse-width-modulated signal; and inverter means, coupled to said resonance circuit and to said modulator means, for exciting the resonance circuit of said heating coil in accordance with said pulse-width-modulated signal to generate said electromagnetic field.

19. An induction heat cooking apparatus in which an electromagnetic field generated by a heating coil is supplied to a load so that the load is inductively heated, said cooking apparatus comprising:

exciter means for exciting said heating coil to generate said electromagnetic field;

temperature setting means for providing a temperature set signal which designates a desired target temperature of said load;

temperature measuring means for measuring a temperature of said load to generate a temperature measure signal indicative thereof;

difference detector means, coupled to said temperature measuring means, said temperature setting means and said exciter means, for detecting a difference between said temperature set signal and said temperature measure signal and generating a difference signal indicative of said difference, said difference signal being coupled to said exciter means to control the degree of excitation thereof so that heat power for said heating coil is continuously controlled in accordance with said difference signal;

judging means, coupled to said difference detector means, for judging whether the value of said difference signal falls within a predetermined range of values, including:

(a) first level means for providing a first level which defines the upper limit of said predetermined range; and (b) second level means for providing a second level which defines the lower limit of said predetermined range;

means for indicating the result of the judgment; and level comparator means, coupled to said indicator means, said first level means, said second level means, and said difference detector means, for comparing the signal level of said difference signal with each of said first and second levels, and for actuating said indicator means to indicate the results of said judgment when the signal level of said difference signal is higher than said second level but lower than said first level.

* * * * *